US011083255B2

(12) United States Patent
Sho

(10) Patent No.: US 11,083,255 B2
(45) Date of Patent: Aug. 10, 2021

(54) SLIDE FASTENER-ATTACHED PRODUCT

(71) Applicant: YKK Corporation, Tokyo (JP)

(72) Inventor: Yoshiyuki Sho, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 16/480,394

(22) PCT Filed: Oct. 6, 2017

(86) PCT No.: PCT/JP2017/036535
§ 371 (c)(1),
(2) Date: Jul. 24, 2019

(87) PCT Pub. No.: WO2018/142673
PCT Pub. Date: Aug. 9, 2018

(65) Prior Publication Data

US 2019/0380455 A1 Dec. 19, 2019

(30) Foreign Application Priority Data

Feb. 2, 2017 (WO) ..... PCT/JP2017/003840

(51) Int. Cl.
*A44B 19/24* (2006.01)
*A44B 19/40* (2006.01)
(Continued)

(52) U.S. Cl.
CPC ..... *A44B 19/403* (2013.01); *A44B 19/08* (2013.01); *A44B 19/26* (2013.01); *A44B 19/28* (2013.01); *A44B 19/38* (2013.01)

(58) Field of Classification Search
CPC ..... A44B 19/403; A44B 19/26; A44B 19/28; A44B 19/38
See application file for complete search history.

(56) References Cited

U.S. PATENT DOCUMENTS 1,813,434 A 7/1931 Bennett
2,067,734 A 1/1937 Silberman
(Continued)

FOREIGN PATENT DOCUMENTS

CN 2688116 Y 3/2005
CN 1275555 C 9/2006
(Continued)

OTHER PUBLICATIONS

U.S. Appl. No. 16/480,508 , Non-Final Office Action, dated Aug. 13, 2020, 7 pages.
(Continued)

*Primary Examiner* — Jason W San
(74) *Attorney, Agent, or Firm* — Kilpatrick Townsend & Stockton LLP

(57) ABSTRACT

These slide fastener-attached products each have: a pair of element members in which fastener elements are attached to a fixing member; a fastener attached member provided with a pair of element attaching edge portion; and sliders. The element members are directly fixed to the element attaching edge portions by sewn portion for fixing, the sewn portion for fixing pierce and pass through the element attaching edge portions, and the sewing thread of the sewn portion for fixing hold the fixing member. In addition, the slide fastener-attached products are provided with protective parts which protect at least a part of the element attaching edge portions from contact with the sliders. Thus, lightweight and improved flexibility of the slide fastener-attached products can be achieved, and the durability of the element attaching edge portions can be improved.

11 Claims, 18 Drawing Sheets

(51) Int. Cl.

| | |
|---|---|
| ***A44B 19/38*** | (2006.01) |
| ***A44B 19/28*** | (2006.01) |
| ***A44B 19/08*** | (2006.01) |
| ***A44B 19/26*** | (2006.01) |

(56) References Cited

U.S. PATENT DOCUMENTS

| | | | | |
|---|---|---|---|---|
| 2,858,592 | A | 11/1958 | Schwartz | |
| 3,132,398 | A * | 5/1964 | Schwendt et al. | A44B 19/403 24/408 |
| 3,302,259 | A | 2/1967 | Waldes | |
| 3,503,102 | A * | 3/1970 | Inazawa | A44B 19/38 24/391 |
| 3,696,473 | A * | 10/1972 | Jones | A44B 19/403 24/408 |
| 3,750,260 | A | 8/1973 | Jakob | |
| 3,849,841 | A | 11/1974 | Borzner | |
| 3,874,038 | A * | 4/1975 | Takamatsu | A44B 19/406 24/413 |
| 3,955,247 | A * | 5/1976 | Takamatsu | A44B 19/14 24/401 |
| 3,977,053 | A | 8/1976 | Takamatsu | |
| 4,033,014 | A * | 7/1977 | Manning | A44B 19/14 24/408 |
| 4,134,184 | A * | 1/1979 | Motta | A44B 19/54 24/396 |
| 4,175,104 | A * | 11/1979 | Moertel | A44B 19/14 24/410 |
| 4,187,791 | A | 2/1980 | Moertel | |
| 4,291,440 | A * | 9/1981 | Yoshida | A44B 19/14 24/408 |
| 4,297,770 | A | 11/1981 | Wulz | |
| 4,418,449 | A * | 12/1983 | Heimberger | A44B 19/06 24/401 |
| 4,425,683 | A | 1/1984 | Hata | |
| 4,425,684 | A | 1/1984 | Akashi et al. | |
| 4,425,685 | A | 1/1984 | Ogihara | |
| 4,458,391 | A * | 7/1984 | Scarpini | A44B 19/346 24/403 |
| 4,485,532 | A * | 12/1984 | Yoshida | A44B 19/38 24/381 |
| 4,490,890 | A | 1/1985 | Yoshida et al. | |
| 4,495,679 | A | 1/1985 | Scarpini | |
| 4,639,981 | A * | 2/1987 | Yoshida | A44B 19/14 24/401 |
| 4,922,584 | A * | 5/1990 | Funakawa | A44B 19/38 24/381 |
| 5,008,986 | A * | 4/1991 | Laudet | A43B 1/0072 24/389 |
| 5,297,319 | A * | 3/1994 | Akashi | A44B 19/34 24/405 |
| 5,469,605 | A * | 11/1995 | Horikawa | A44B 19/34 24/403 |
| 5,678,285 | A | 10/1997 | Germani | |
| 6,065,192 | A | 5/2000 | Wang | |
| 6,352,044 | B1 | 3/2002 | Peng | |
| 8,572,816 | B2 * | 11/2013 | Dono | A44B 19/12 24/413 |
| 2002/0100148 | A1 * | 8/2002 | Tominaga | A44B 19/12 24/391 |
| 2004/0181919 | A1 * | 9/2004 | Mizuhara | A44B 19/38 24/387 |
| 2005/0034284 | A1 * | 2/2005 | Yu | A44B 19/34 24/397 |
| 2005/0235466 | A1 | 10/2005 | Segawa et al. | |
| 2005/0257350 | A1 * | 11/2005 | Takamatsu | A44B 19/60 24/436 |
| 2009/0013505 | A1 | 1/2009 | Hasegawa et al. | |
| 2011/0005042 | A1 * | 1/2011 | Thomas | A44B 19/34 24/381 |
| 2012/0110795 | A1 * | 5/2012 | Daijogo | D03D 1/00 24/392 |
| 2012/0246888 | A1 * | 10/2012 | Matsushima | D05B 35/064 24/403 |
| 2013/0133161 | A1 | 5/2013 | Ren | |
| 2015/0033512 | A1 * | 2/2015 | Kojima | A44B 19/06 24/430 |
| 2016/0095405 | A1 * | 4/2016 | Wang | A45C 13/103 24/381 |
| 2016/0206054 | A1 * | 7/2016 | Ni | A44B 19/403 |
| 2017/0265605 | A1 * | 9/2017 | Davis | A44B 19/02 |
| 2017/0280832 | A1 | 10/2017 | Kojima et al. | |
| 2019/0357638 | A1 | 11/2019 | Sho et al. | |

FOREIGN PATENT DOCUMENTS

| | | | |
|---|---|---|---|
| CN | 103153122 | A | 6/2013 |
| CN | 103269616 | A | 8/2013 |
| CN | 104334785 | A | 2/2015 |
| CN | 108236164 | A | 7/2018 |
| EP | 0107113 | A1 | 5/1984 |
| EP | 1459643 | A2 | 9/2004 |
| EP | 2764790 | A1 | 8/2014 |
| FR | 2247999 | A1 | 5/1975 |
| GB | 2083548 | A | 3/1982 |
| GB | 2319806 | A | 6/1998 |
| JP | 40-13870 | A | 5/1965 |
| JP | 52-141747 | A | 11/1977 |
| JP | 56-089204 | A | 7/1981 |
| JP | 62-299205 | A | 12/1987 |
| JP | 2004-283300 | A | 10/2004 |
| TW | 201609016 | A | 3/2016 |
| WO | 2010/032331 | A1 | 3/2010 |
| WO | 2011/077534 | A1 | 6/2011 |
| WO | 2012/090276 | A1 | 7/2012 |
| WO | 2014102941 | | 7/2014 |

OTHER PUBLICATIONS

Office Action, Japanese Patent Application No. 2018-565923, dated Mar. 10, 2020.

Office Action, Japanese Patent Application No. 2018-565922, dated Mar. 10, 2020.

Office Action, Japanese Patent Application No. 2018-565921, dated Mar. 10, 2020.

European Supplementary Search Report, European Patent Application No. 17894796.6, dated Oct. 6, 2020, 10 pages.

European Supplementary Search Report, European Patent Application No. 17894731.3, dated Oct. 8, 2020, 9 pages.

Office Action, Chinese Patent Application No. 201810120807.7, dated Sep. 30, 2020, 34 pages.

U.S. Appl. No. 16/476,754 , Non-Final Office Action, dated Oct. 14, 2020, 6 pages.

U.S. Appl. No. 16/480,430, Non-Final Office Action, dated Nov. 9, 2020, 13 pages.

International Search Report, PCT Application No. PCT/JP2017/036535, dated Dec. 12, 2017.

International Search Report, PCT Application No. PCT/JP2017/003840, dated Apr. 25, 2017.

PCT International Application No. PCT/JP2017/036533, International Search Report dated Dec. 12, 2017.

PCT International Application No. PCT/JP2017/036534, International Search Report dated Dec. 12, 2017.

Office Action, Chinese Patent Application No. 201711285372.3, dated Apr. 3, 2020.

Office Action, Chinese Patent Application No. 201810120807.7, dated Mar. 23, 2020.

Office Action, Chinese Patent Application No. 201810090675.8, dated Mar. 27, 2020.

U.S. Appl. No. 16/476,754, Notice of Allowance, dated Jan. 22, 2021, 7 pages.

U.S. Appl. No. 16/480,508, Notice of Allowance, dated Dec. 2, 2020, 7 pages.

U.S. Appl. No. 16/480,508, Notice of Allowance, dated Feb. 24, 2021, 7 pages.

(56) References Cited

OTHER PUBLICATIONS

European Patent Application No. 17894888.1 , Extended European Search Report, dated Dec. 1, 2020, 9 pages.
Office Action, Chinese Patent Application No. 201810120863.0, dated Apr. 17, 2021, 17 pages.
Office Action, Taiwanese Patent Application No. 106119596, dated Nov. 27, 2017, 17 pages.
Office Action, Chinese Patent Appication No. 201810120807.7, dated Mar. 2, 2021, 43 pages.

* cited by examiner

SLIDE FASTENER-ATTACHED PRODUCT

TECHNICAL FIELD

The invention relates to a slide fastener-attached product formed by directly attaching an element member in which a plurality of fastener elements are attached to a fixing member at equal intervals to an element-attaching edge part provided with a product such as clothes, the element member used for the slide fastener-attached product, and a manufacturing method of the slide fastener-attached product.

BACKGROUND ART

A slide fastener is often and generally used as an opening and closing tool for products such as clothes, commodities and industrial materials and also for products such as various kinds of seats for automobiles, trains and aircrafts. The slide fastener used for such various kinds of products generally has a right and left pair of fastener stringers in which element rows are formed at tape side edge parts of fastener tapes and a slider sliding along the right and left element rows.

For example, a fastener stringer in which continuous fastener elements are formed by molding monofilaments made of thermoplastic resin in a coiled or zigzag shape and element rows are formed by sewing the continuous fastener elements on the tape side edge part of the fastener tape is known as a general one. In addition, a fastener stringer in which element rows are formed by forming a plurality of independent fastener elements at predetermined intervals by injection molding of synthetic resin directly or by die-casting of metal to the tape side edge part of the fastener tape is also known.

Further, such an example of the slide fastener which is formed by sewing an element member in which a plurality of fastener elements are connected with a supporting string to an edge of the fastener tape with overlock stitches (over-edge chain stitches) is disclosed in Japanese Utility Model Publication No. S40-13870 (Patent Document 1).

In a case that the element member is sewn to the fastener tape by using an overlock sewing machine as above, for example, a sewing (needle thread) thread disposed on a tape top surface side of the fastener tape is disposed so as not to overlap the fastener elements. On the other hand, a sewing thread (looper thread) disposed on a tape back surface side tends to overlap with the fastener elements on the tape back surface side due to a movement of a looper of the overlock sewing machine. Thus, in a case that the fastener stringer is formed using the overlock stitches as in Patent Document 1, high technical capability not to overlap the looper thread with the fastener elements is needed.

Meanwhile, in the conventional slide fastener including the slide fastener of Patent Document 1 or in the conventional fastener stringer, the element rows are formed at the tape side edge parts of the fastener tapes by attaching coil-shaped continuous fastener elements or fastener elements made of synthetic resin by injection-molding are attached to the tape side edge parts. In addition, in a case that the slide fastener is attached to a fastener attached member such as clothes, it is common to sew a part other than the tape side edge part of the fastener tape (generally called as "tape main body portion") and a fastener attaching portion of the fastener attached member together in a state that the part other than the tape side edge part of the fastener tape overlaps the fastener attaching portion of the fastener attached member.

Therefore, in a general slide fastener, a fastener tape is generally used as an essential member (parts) for consisting a slide fastener. As the slide fastener has the fastener tape and is attached to a fastener-attached member such as clothes via the fastener tape, thereby, when a slider is slid along an element row, right and left flange portions disposed on the slider is slide-contacted with the formed fastener tape with a relatively strong force not to be directly slide-contacted (or less likely to be slide-contacted) to the product such as clothes. Thereby, even when the sliding operation is repeated, the product itself is not (or less) scratched or rubbed by slide-contacting of the slider, and a damage of the product cloth due to the scratch or friction by the slider is prevented.

Meanwhile, in order to improve visual quality (appearance quality) such as a color of a slide fastener-attached product and for weight saving and the like, an example that an element member in which continuous fastener elements or a plurality of fastener elements are fixed to a core string are directly woven-fixed or knitted-fixed to a cloth of a product when weaving or knitting the cloth is disclosed in Japanese Patent Publication No. S62-299205 (Patent Document 2). Thus, it is possible to attach the fastener elements to the product cloth directly without using a fastener tape.

In a case that the fastener elements are woven or knitted directly to the cloth of the product as in Patent Document 2, it is possible to reduce working processes in manufacturing the slide fastener-attached products, for example, in comparison with a case that after the slide fastener is manufactured, the slide fastener-attached product is manufactured by sewing the fastener tape of the slide fastener to the cloth of the product. Thus, acceleration of a production line and cost reduction can be expected.

Further, since the fastener elements can be woven-fixed or knitted-fixed directly to the cloth of the product, the fastener tape as an essential component of the slide fastener becomes unnecessary. Thus, weight saving and improvement of flexibility of the slide fastener-attached products can be also expected.

PRIOR ART DOCUMENTS

Patent Documents

Patent Document 1: Japanese Utility Model Publication No. S40-13870

Patent Document 2: Japanese Patent Publication No. JP S62-299205

SUMMARY OF INVENTION

Problem to be Solved by the Invention

Recently, added values of products like clothing such as clothes, bags and shoes are enhanced by improving a nature corresponding to their uses and by applying various functions. For example, further weight saving and improvement of flexibility are required for clothing and bags used on a daily basis.

However, for the conventional slide fasteners including the ones described in the above-mentioned Patent Document 1, a fastener tape, a fastener element and a slider are essential as components of the slide fastener. Therefore, as for a slide fastener-attached product to which a slide fastener is attached, weight saving of the slide fastener is limited. In addition, since the fastener tape of a fastener stringer is attached to a fastener attaching portion of the product by sewing processing using a sewing machine, flexibility of the product may be deteriorated.

On the other hand, for example, as described in Patent Document 2, in a case of manufacturing a slide fastener-attached product by weave-fixing or knit-fixing the fastener elements or the element members directly to a cloth of the product, the fastener tapes become unnecessary, which enables weight saving of the slide fastener-attached product to be easily achieved.

However, to weave-fix or knit-fix the fastener elements directly to the cloth of the product, high technology and designated equipment are necessary. As a result, equipment cost increases and securing and training matured engineers are needed.

Further, desired functions are provided to the cloth by coating the cloth of the product with synthetic resin, for example, corresponding to a use of the product in some cases. However, in a case of weave-fixing or knit-fixing the fastener elements directly in weaving or knitting the cloth of the product as in Patent Document 2, it may be difficult to add the desired functions stably by coating the cloth with synthetic resin.

Further, in the slide fastener-attached product in Patent Document 2, the fastener elements are directly attached to the product cloth. Therefore, when the slider of the slide fastener is slid along the element rows, the right and left flange portions disposed in the slider are directly slide-contacted with the product cloth. As a result, as the sliding operation of the slider is repeated, thereby the product cloth is repeatedly scratched or rubbed along the slide-contact of the slider, and the product cloth is considered to be easily damaged.

The present invention is invented in light of the above conventional problems, and its specific object is to provide a slide fastener-attached product in which an element member provided with a plurality of fastener elements is directly attached to a fastener-attached member of a product without interposing a fastener tape, from which weight saving and improvement of flexibility can be expected in comparison with the conventional and general slide fastener-attached products, and in which the fastener-attached member of the product is less damaged despite repeated sliding operation of the slider, an element member used for the slide fastener-attached product, and a manufacturing method of the slide fastener-attached product.

Means for Solving the Problem

To achieve the above object, a slide fastener-attached product provided by the present invention has a pair of element members in which fastener elements are attached to a fixing member, a fastener attached member having a pair of element attaching edge portions to which the element members are attached in a position facing to each other, and at least one slider attached to the element rows formed of the fastener elements in a slidable manner, in which the element member is directly fixed to the element attaching edge portion with a sewn portion for fixing, the sewn portion for fixing pierces the element attaching edge portion and a sewing thread forming the sewn portion for fixing holds the fixing member, and a protective part protecting at least a part of the element attaching edge portion from a contact with the slider.

In the slide fastener-attached product according to the present invention, it is preferable that a slider-faced area facing to a part of the slider to be slid is disposed at the element attaching edge portion of the fastener-attached member along a length direction of the element member, the sewing thread of the sewn portion for fixing is disposed on at least a part of the slider-faced area of the element attaching edge portion, and the protective part is formed of the sewing thread in the slider-faced area.

In this case, it is preferable that the sewing thread of the sewn portion for fixing is disposed in a zigzag shape as the protective part in the slider-faced area of the element attaching edge portion.

It is also preferable that the slider has an upper blade and a lower blade disposed parallel to each other, a connecting column connecting the upper blade and the lower blade, and a flange portion disposed at each of right and left side edge parts of at least one of the upper blade and the lower blade, and at the element attaching edge portion of the fastener-attached member, the slider-faced area is disposed along the length direction of the element member so as to face the flange portion of the sliding slider.

In the slide fastener-attached product of the present invention, it may be possible that the slider has an upper blade and a lower blade disposed parallel to each other, a connecting column connecting the upper blade and the lower blade and a flange portion disposed on each of right and left side edge parts of at least one of the upper blade and the lower blade, in which the fastener element has a concave portion for flange disposed on at least one of an upper half portion and a lower half portion of the fastener element and along the length direction of the element member and disposed to correspond to a position of the flange portion of the slider, and the protective part is formed of the concave portions for flange of a plurality of the fastener elements.

In this case, it is preferable that the fastener element has a first element portion including a coupling head portion to be engaged with the fastener element of a coupling counterpart side and having a dimension in an element thickness direction to correspond to an interval between the upper blade and the lower blade in the slider, and a second element portion extending from the first element portion in a direction to be apart with respect to the coupling head portion in the width direction and having a smaller dimension in the element thickness direction than the first element portion via a step, and the concave portion for flange is formed in the fastener element by a difference in a dimension in the element thickness direction between the first element portion and the second element portion.

In the slide fastener-attached product of the present invention, it is preferable that the sewn portion for fixing is formed by lock stitching.

It is also preferable that the sewn portion for fixing is formed to be bent in a zigzag shape with respect to the length direction of the element member.

Further, it is preferable that a plurality of the fastener elements are respectively formed independently and disposed on the fixing member at an equal interval, and the sewn portion for fixing is formed such that the sewing thread repeats a predetermined pattern of stitches per fastener element.

In the slide fastener-attached product of the present invention, it is preferable that the element attaching edge portion of the fastener attached member is formed such that a side edge part of the fastener attached member is folded in a width direction of the element member.

In the fastener-attached product of the present invention, it is preferable that the fastener element has a body portion fixed to the fixing member and a coupling portion engaging with the fastener element of the element member on the coupling counterpart side, and the body portion has a tapered portion in which a dimension of the body portion in the length direction of the element member is gradually decreased with distance from the coupling portion in a plan view of the fastener element.

Next, an element member provided by the present invention has, in the element member attachable to the fastener attached member, a fixing member and fastener elements to be attached to the fixing member, in which each fastener element has a body portion fixed to the fixing member and a coupling head portion extending in a width direction of the element member from the body portion, the fastener element has a first element portion including the coupling head portion and having a predetermined size of dimension in an element thickness direction, and a second element portion having a smaller dimension in the element thickness direction than the first element portion via a step, and a concave portion formed by a difference in the element thickness dimension between the first element portion and the second element portion in the fastener element.

Next, a manufacturing method provided by the present invention is a manufacturing method of a slide fastener-attached product including: forming an element member to which fastener elements are attached to a fixing member, forming a fastener attached member provided with an element attaching edge portion, and performing a sewing processing to the fastener attached member and the element member using a sewing machine to form a sewn portion for fixing as well as to fix the element member to the element attaching edge portion of the fastener attached member with the sewn portion for fixing.

The manufacturing method of the present invention preferably includes forming the sewn portion for fixing by lock stitching to bend in a zigzag shape with respect to the length direction.

Effects of the Invention

The slide fastener-attached product according to the present invention has a right and left pair of element members formed by attaching a plurality of independent fastener elements to a long flexible fixing member at an equal interval, fastener attached members provided with a right and left pair of element attaching edge portions to which the element members are attached at a position facing to each other, and at least one slider attached to element rows formed of a plurality of the fastener elements to be able to slide.

Each of the right and left element members is directly fixed to the corresponding element attaching edge portion of the fastener attached member with the sewn portion for fixing. In this case, the sewn portion for fixing pierces the element attaching edge portion, and a sewing thread forming the sewn portion for fixing holds the fixing member of the element member. Further, in the slide fastener of the present invention, a protective part protecting at least a part of the element attaching edge portion from contact with the slider.

According to the slide fastener-attached product of the present invention as above, the element member is easily and stably fixed to the element attaching edge portion of the fastener attached member with the sewn portion for fixing, and a fixing state of the element member is stably maintained. Therefore, functions of the slide fastener formed on the product can be stably exerted for a long period of time.

Further, in the slide fastener-attached product of the present invention, a slide fastener can be configured without using a fastener tape which had been an essential component in conventional slide fasteners. Since the fastener tape is unnecessary as above, weight saving and flexibility of the slide fastener-attached product can be improved. In the present invention, the element member is directly fixed to the fastener attached member to which a desired function such as waterproof is provided with the sewn portion for fixing formed by a sewing machine, the slide fastener-attached product in which the fastener attached member (cloth) has a special function can be easily manufactured at a low cost.

Further in the present invention, the protective part protecting at least a part of the element attaching edge portion from a contact with the slider is formed. Therefore, in a case of repeating the slide operation of the slider, scratch or friction at the element attaching edge portion of the fastener attached member is suppressed with the protective part, and the fastener attached member can be less damaged.

Therefore, in the slide fastener-attached product of the present invention, usability and convenience of the slide fastener can be significantly improved. Thus, the product of the present invention is used more suitably for daily items such as cloths, shoes and bags, and in addition to the daily items, it is used suitably for various products such as industrial materials and seats for automobiles or airplanes.

In the slide fastener-attached product of the present invention as mentioned above, at the element attaching edge portion of the fastener attached member, a slider-faced area facing to a part of the sliding slider is disposed along the length direction of the element member, and the sewing thread of the sewn portion for fixing is disposed to be exposed on at least a part of the facing surface of the slider-faced area in the element attaching edge portion. The protective part protecting the element attaching edge portion is formed with the sewing thread of the slider-faced area.

As above, the protective part protecting the element attaching edge portion is formed with the sewing thread disposed on the slider-faced area of the element attaching edge portion, thereby the protective part can be easily and stably provided. Further, the element attaching edge portion of the fastener attached member can be protected effectively by the protective part with the sewing thread from the slide contact with the slider.

Particularly in this case, the sewing thread of the sewn portion for fixing is disposed as the protective part in a zigzag shape in the slider-faced area of the element attaching edge portion. Thereby, the element attaching edge portion of the fastener attached member can be protected more effectively from the slide contact with the slider.

The slider of the present invention has an upper blade and a lower blade disposed parallel to each other, a connecting column connecting the upper blade and the lower blade and a flange portion disposed on each of right and left side edge parts of at least one of the upper blade and the lower blade. In this case, in the element attaching edge portion of the fastener attached member, the slider-faced area is disposed so as to face to the flange portion of the sliding slider along the length direction of the element member. Thereby, the element attaching edge portion of the fastener attached member can be protected more effectively by the protective part formed with the sewing thread of the sewn portion for fixing from the slide contact with the flange portion of the slider.

In the slide fastener-attached product of the present invention, and in a case the slider has the upper blade and the lower blade disposed to be parallel to each other, the connecting column connecting the upper blade and the lower blade and the flange portion disposed on each of right and left side edge parts of at least one of the upper blade and the lower blade, the fastener element may have a concave portion for flange on at least one of the upper half portion and the lower half portion of the fastener element to be disposed along the length direction of the element member and disposed corresponding to a position of the flange portions of the slider. In this case, the protective part protecting the element attaching edge portion is formed of the concave portions for flange of a plurality of the fastener elements.

Thus, at the time of sliding the slider, the flange portion of the slider can move while being accommodated in the concave portions for flange formed on a plurality of the fastener elements, thereby the flange portion is not (or less likely to be) directly slide-contacted with the element attaching edge portions of the fastener attached member, and therefore the fastener attached member can be effectively prevented from being damaged caused by sliding of the slider.

In this case in particular, the fastener element has the first element portion including the coupling head portion which engages with the fastener element on the coupling counterpart side and having a dimension in the element width direction which correspond to an interval between the upper blade and the lower blade in the slider, and the second element portion extending from the first element portion in a direction to be apart with respect to the coupling head portion in the width direction and having a smaller dimension in the element thickness direction than the first element portion via the step. Thereby, the concave portion for flange as a protective part is easily formed on the fastener element by a difference in the element thickness dimension between the first element portion and the second element portion. Therefore, the element attaching edge portion of the fastener attached member can be stably protected by the concave portion for flange provided on a plurality of the fastener elements from the flange portion of the slider.

In such a slide fastener-attached product in the present invention, the sewn portion for fixing which fixes the element member to the element attaching edge portion is formed of the lock stitching. Particularly, the sewn portion for fixing of the present invention is formed to be bent in a zigzag shape with respect to the length direction of the element member.

For the slide fastener-attached product provided with the sewn portion for fixing as mentioned above, the element member can be easily and stably sewn to the element attaching edge portion of the fastener attached member by using a zigzag stitch sewing machine, for example. Therefore, without introducing a new expensive and exclusive equipment, the slide fastener-attached product of the present invention can be manufactured stably and at a low cost. Further in this case, the protective part protecting the element attaching edge portion can be easily formed by the sewing thread of the sewn portion for fixing, and the protective part with the sewing thread can be symmetrically formed on both surfaces of the top surface (upper surface) and the back surface (lower surface) of the element attaching edge portion. Thus, when the slider on which the flanges are disposed on both the upper blade and the lower blade is used, the element attaching edge portion of the fastener attached member can be protected more effectively from the slider.

In the slide fastener-attached product of the present invention, a plurality of the fastener elements are independently formed of synthetic resin respectively, and disposed at an equal interval on the fixing member. The sewn portion for fixing is formed such that the sewing thread repeats a predetermined pattern of stitches per fastener element. Thereby the element member is smoothly and stably attached to the element attaching edge portion of the fastener attached member, and the element row is formed property at the element attaching edge portion.

Further, in the slide fastener-attached product of the present invention, the element attaching edge portion of the fastener attached member is formed such that a side edge part of the fastener attached member is folded in a width direction of the element member. Thereby, strength of the element attaching edge portion of the fastener attached member can be easily enhanced. Also thereby the element member is fixed more firmly to the element attaching edge portion of the fastener attached member, and a position and a columnure of each element with respect to the fastener attached member can be more stabilized.

In addition, as the side edge part of the fastener attached member is folded in a width direction of the element member, even when a side end edge of the fastener attached member (cloth) is frayed, for example, it is possible that the fray is hidden on the back surface side of the element attaching edge portion, and is not shown on the outer side. Therefore, outer appearance quality (appearance) of the slide fastener-attached product can be enhanced. Further, it can be prevented that the fray on the side end edge deteriorates coupling of the right and left element rows or lowers slidability of the slider.

Further, in the slide fastener-attached product of the present invention, each fastener element has a body portion fixed to the fixing member, and a coupling portion (neck portion and coupling head portion described later) engaging with a fastener element of the element member on the coupling counterpart side. The body portion of the fastener element has, in a plan view or a bottom view of the fastener element, a body tip end portion disposed near the coupling portion and having a dimension of the body portion of the element member in the length direction to be a constant size or gradually increase with distance from the coupling portion, and a tapered portion extending from the body tip end portion in a direction apart from the coupling portion and having a dimension of the body portion of the element member in the length direction to gradually decrease with distance from the coupling portion. The dimension of the body portion in the length direction here means a dimension between a front surface part and a rear surface part in the body portion in the length direction in the plan view of the fastener element.

Since each fastener element has the tapered portion as mentioned above, when the sewn portion for fixing which fixes the element member is formed to be bent in a zigzag shape, for example, the sewing thread (upper thread and lower thread of lockstitches) of the sewn portion for fixing can be less overlapped on the fastener element. Thereby, it can be prevented that the sewing thread of the sewn portion for fixing is loosened, and the fixing state of the element member to the fastener attached member can be stably maintained. Further, it can be also prevented that coupling of the right and left element rows is worsened or slidability of the slider is lowered caused by the overlap of the sewing thread of the sewn portion for fixing on the fastener element.

Next, the element member according to the present invention is an element member which is attachable to the fastener attached member, and has a long length fixing member which has flexibility, and a plurality of independent fastener elements attached to the fixing member at equal intervals. Each fastener element of the element member has a body portion fixed to the fixing member, and a coupling head portion extending from the body portion in the width direction of the fastener element via a neck portion.

The fastener element also has a first element portion including the coupling head portion and having a dimension in the element thickness direction to be set at a predetermined size which corresponds to an interval between the upper blade and the lower blade of the slider, for example, and a second element portion including at least a part of the body portion and having a dimension in the element thickness direction smaller than the first element portion via a step. Further, in the fastener element, a concave portion which can accept the flange portions of the slider made by a difference in the element thickness dimension between the first element portion and the second element portion.

Since the concave portion as mentioned above is formed along the length direction of the element member through a plurality of the fastener elements, when the slider slides, the flange portion of the slider can move in the concave portion of the fastener element, thereby the flange portions of the slider can be prevented from directly slide-contacting with the element attaching edge portion of the fastener attached member, and the fastener attached member can be stably protected from the slider.

The element member of the present invention can be directly fixed to the element attaching edge portion of the fastener attached member using a sewing machine. When the slide fastener-attached product is manufactured using the element member of the present invention as above, the flange portion of the slider can be accepted and accommodated in the concave portion (concave portion for flange) formed on each fastener element of the element member, thus the concave portion of the fastener element serves as the protective part which protects the fastener attached member from the slider as mentioned above. Therefore, even when the sliding operation of the slider is repeated, the flange portion of the slider is blocked not to be directly slide-contacted with the element attaching edge portion of the fastener attached member, and damages of the fastener attached member due to sliding of the slider can be effectively prevented.

Next, as a manufacturing method of the slide fastener-attached product according to the present invention, first, an element member is formed in which fastener elements having a predetermined shape are fixed to a fixing member by injection-molding synthetic resin to the fixing member. Also, a fastener attached member provided with an element attaching edge portion is formed separately from the element member.

Subsequently, a sewn portion for fixing is formed by performing a sewing processing to the produced fastener attached member and the element member using a sewing machine, and at the same time, the element member is directly fixed to the element attaching edge portion of the fastener attached member with the sewn portion for fixing. Thereby, an element row is formed along the element attaching edge portion of the fastener attached member. Thereafter, by attaching a slider to the element row, for example, the slide fastener-attached product without using a fastener tape can be easily manufactured. As a result, reduction in manufacturing cost, weight saving and improvement in flexibility can be achieved.

In the manufacturing method in the present invention as mentioned above, the sewn portion for fixing which fixes the element member to the element attaching edge portion of the fastener attached member is formed to be bent in a zigzag shape with respect to the length direction by lock stitching. Thereby, the element member can be easily and stably fixed to the fastener attached member. Also, the slide fastener-attached product can be manufactured at a low cost by using a general zigzag sewing machine, for example, instead of introducing an expensive and exclusive equipment. Further in this case, it becomes possible that the above-mentioned protective part which protects the element attaching edge portion is easily formed with the sewing thread of the sewn portion for fixing, and at the same time, the protective part with the sewing thread is formed symmetrically on both surfaces of the top surface (upper surface) and the back surface (lower surface) of the element attaching edge portion. Therefore, the element attaching edge portion of the fastener attached member can be protected from the slider more effectively.

DESCRIPTION OF EMBODIMENT

Hereinafter, preferred embodiments of the present invention are described in detail with Embodiments referring to drawings. It should be noted that the present invention is not limited thereto, and various changes can be made as far as they have a substantially same structure and same functional effects.

For example, in the Embodiments below, cases that a slide fastener-attached product means a slide fastener-attached clothing item are explained, but the slide fastener-attached product according to the present invention is not limited to clothing item (clothes) and includes various products such as commodities like shoes and bags, products such as industrial materials, and various kinds of seats for automobiles, trains and aircrafts.

Moreover, in the following Embodiments 1, 2, etc, the slide fastener formed on the product (clothing item) is formed as a general slide fastener having one slider. However, it is also possible in the present invention that a reverse-opening or double-opening slide fastener in which two sliders are attached to element rows in a predetermined direction, for example, is formed to be the product.

Embodiment 1

Figure 1:
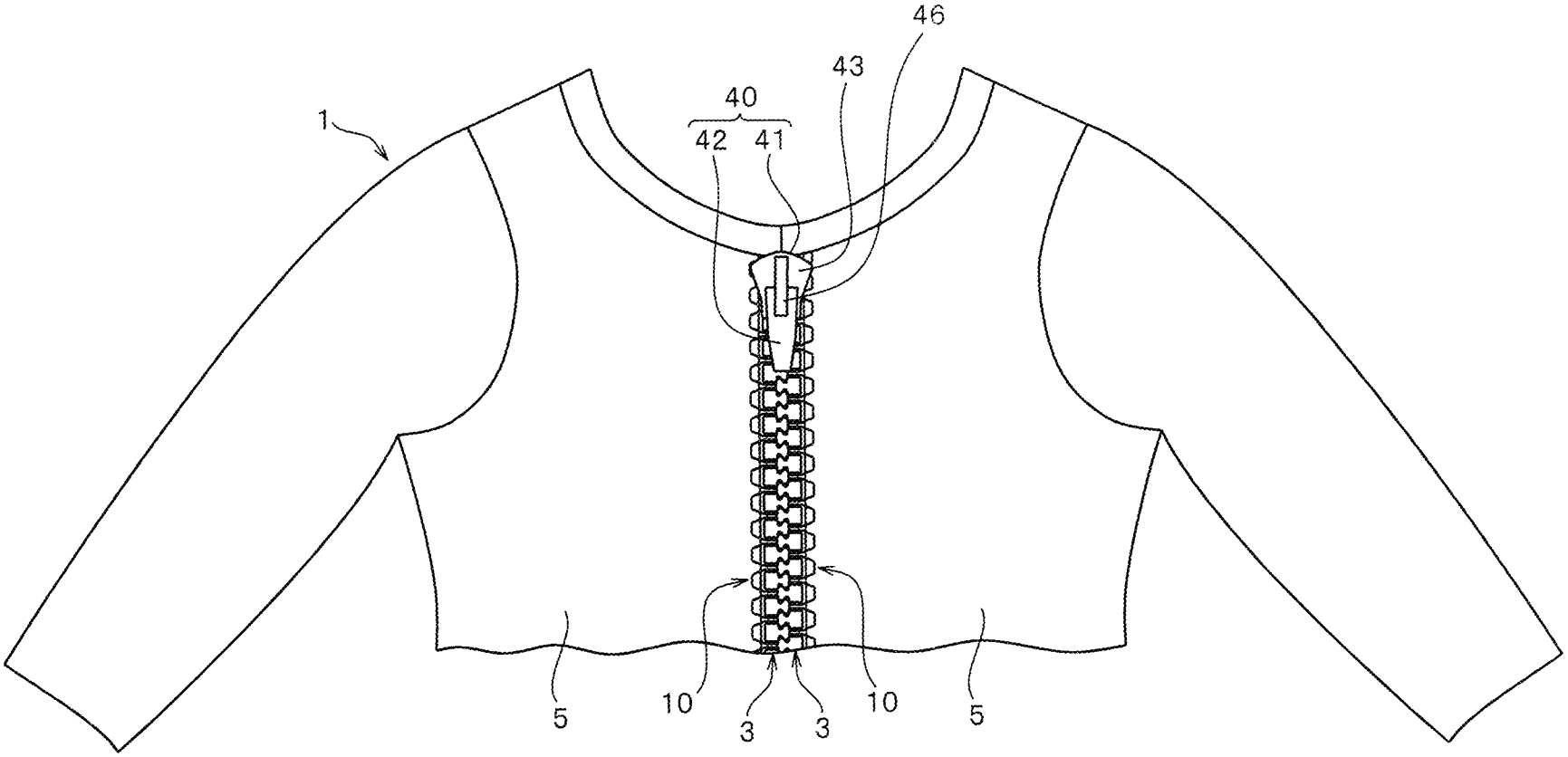
FIG. 1 is a schematic view illustrating a slide fastener-attached product (clothing item) according to Embodiment 1 of the present invention.
Figure 2:
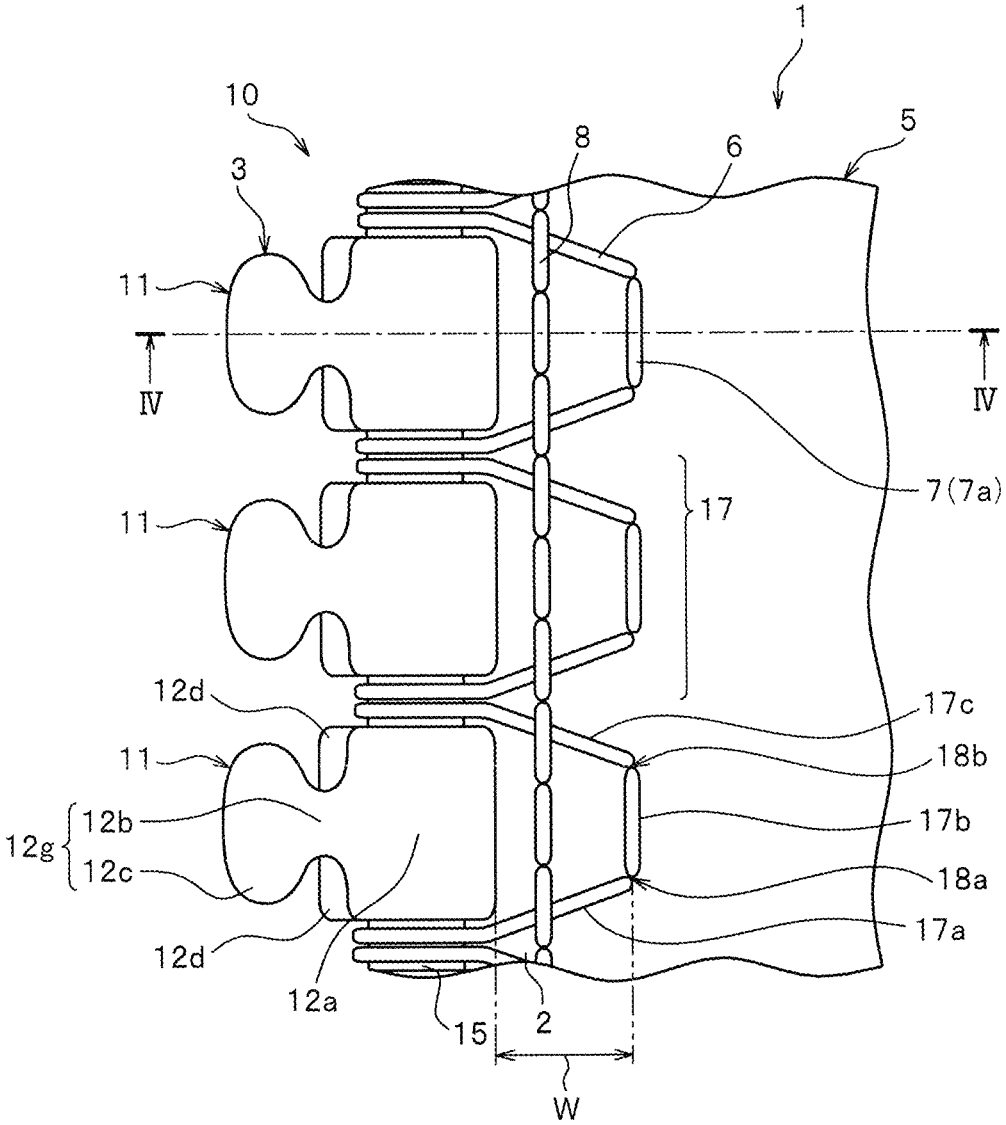
FIG. 2 is an enlarged plan view of Embodiment 1 showing an enlarged part in which the element member is attached to the fastener attaching edge portion.
Figure 3:
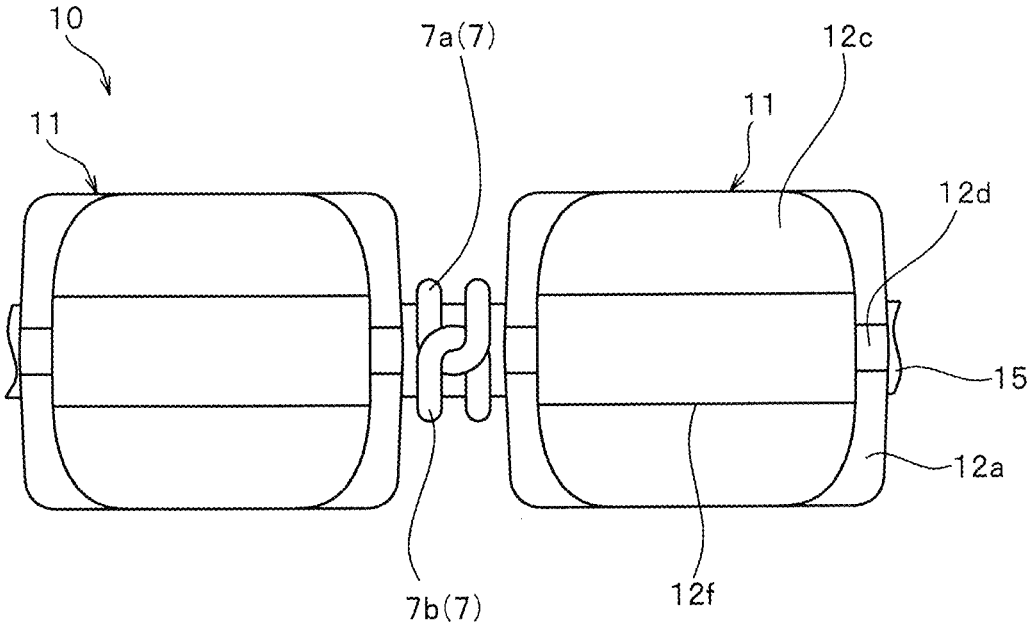
FIG. 3 is a side surface view showing a part in which the element member is attached to the fastener attaching edge portion of the product viewed from an element member on a coupling counterpart side.
Figure 4:
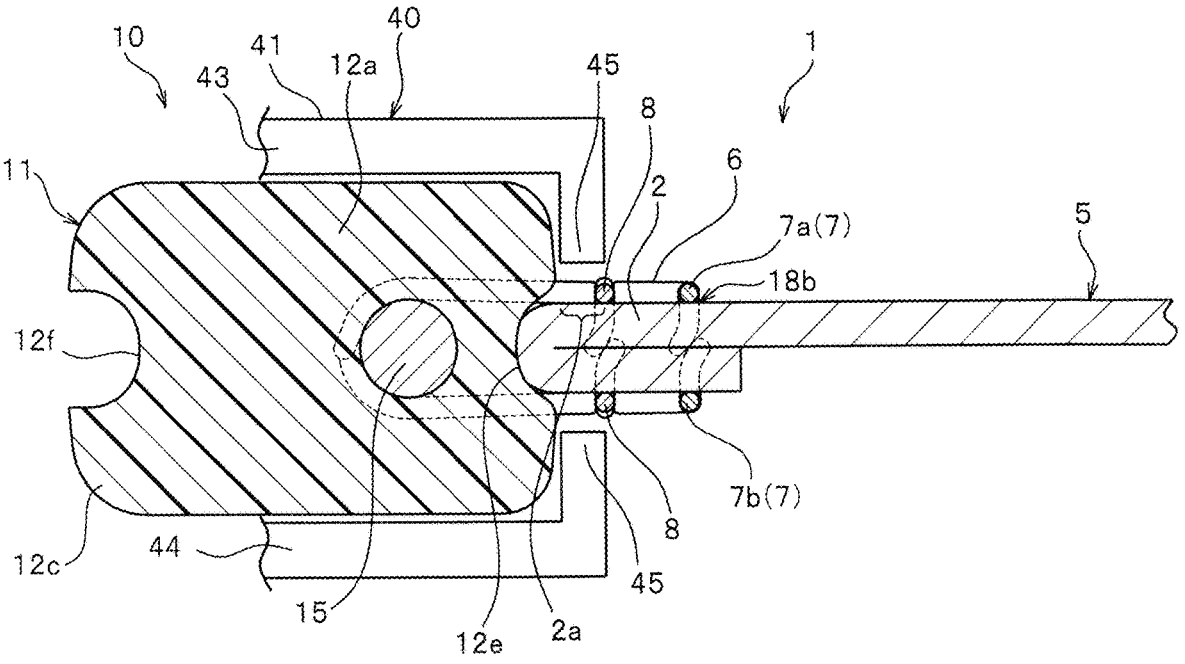
FIG. 4 is a cross-sectional view along the line IV-IV in FIG. 2.

FIG. 1 is a schematic view illustrating a slide fastener-attached clothing item according to Embodiment 1 of the present invention. FIG. 2 is an enlarged plan view showing an enlarged part in which the element member is attached to the fastener attaching portion of the clothing item, and FIG. 3 is a side surface view showing the part viewed from the element member on a coupling counterpart side along the width direction of the element member. FIG. 4 is a cross-sectional view along the line IV-IV in FIG. 2.

In the following explanation, a front and rear direction means a length direction of an element member parallel to a slider sliding direction. Particularly, the direction in which the slider slides so as right and left element rows to be coupled means a front, and the direction in which the slider slides so as the right and left element rows to be separated means a rear.

A right and left direction means a width direction of the element member (or a width direction of a cloth to be a fastener attached member), and for example, a direction perpendicular to the slider sliding direction and parallel to a top surface and a back surface of the cloth. An upper and lower direction means a direction perpendicular to the front and rear direction and the right and left direction, and for example, a thickness direction of the element member perpendicular to the top surface (upper surface) and the back surface (lower surface) of the cloth. Particularly in the following cases, a direction in which a tab of the slider is disposed with respect to the element member means upper and the opposite direction means lower.

A slide fastener-attached product 1 according to Embodiment 1 is a slide fastener-attached clothing item (clothes) 1, and a slide fastener is formed at front placket parts in a front body of the clothing item 1.

Also, right and left element attaching edge portions 2 on which right and left element members 10 are respectively attached are disposed on right and left cloths 5 forming the front body (particularly front placket parts) which becomes an opening and closing part of the clothing item 1.

In this case, the cloth 5 configuring the front placket part of the clothing item (also referred to as a garment cloth) becomes a fastener attached member to which the element member 10 is attached. Accordingly, the slide fastener configured in Embodiment 1 has a right and left pair of fastener stringer portions provided with element rows 3 formed by directly fixing the element member 10 to the cloth 5, and a slider 40 which can couple and separate the element rows 3 of the right and left fastener stringer portions.

The cloth 5 which becomes the fastener attached member has functions and properties (flexibility, thickness, texture, color and others) necessary to the clothing item. In Embodiment 1, the cloth 5 to which the element member 10 is sewn is cut in a predetermined shape and dimension depending on a shape and a design of the clothing item. Here, although a thickness of a general conventional fastener tape is 1.1 mm to 1.5 mm, the cloth 5 which is the fastener attached member used in Embodiment 1 and a cloth of other parts are formed to be thin in view of weight reduction, and has a thickness of 0.2 mm or more and 1.0 mm or less, for example, and preferably 0.4 mm or more and 0.7 mm or less.

In Embodiment 1, the right and left element attaching edge portions 2 provided on the cloth (fastener attached member) 5 are disposed at positions facing to each other in the front body of the clothing item (i.e. facing edge portions of the front body) linearly and continuously. Here, the element attaching edge portion 2 provided on the cloth 5 is a part (area) having a predetermined dimension from facing side ends which face to each other of the cloth 5 which configures the right and left front placket portions toward an inside of the cloth 5 in the width direction of the element member 10. Therefore, the element attaching edge portion 2 of the cloth 5 is formed to have a constant width dimension along a length direction of the element member 10. The element attaching edge portion 2 is a part that a sewing thread 7 of a sewn portion for fixing 6 pierces, as described later, and a part contacting with a body portion 12*a* of a fastener element 11, as described later.

Figure 5:
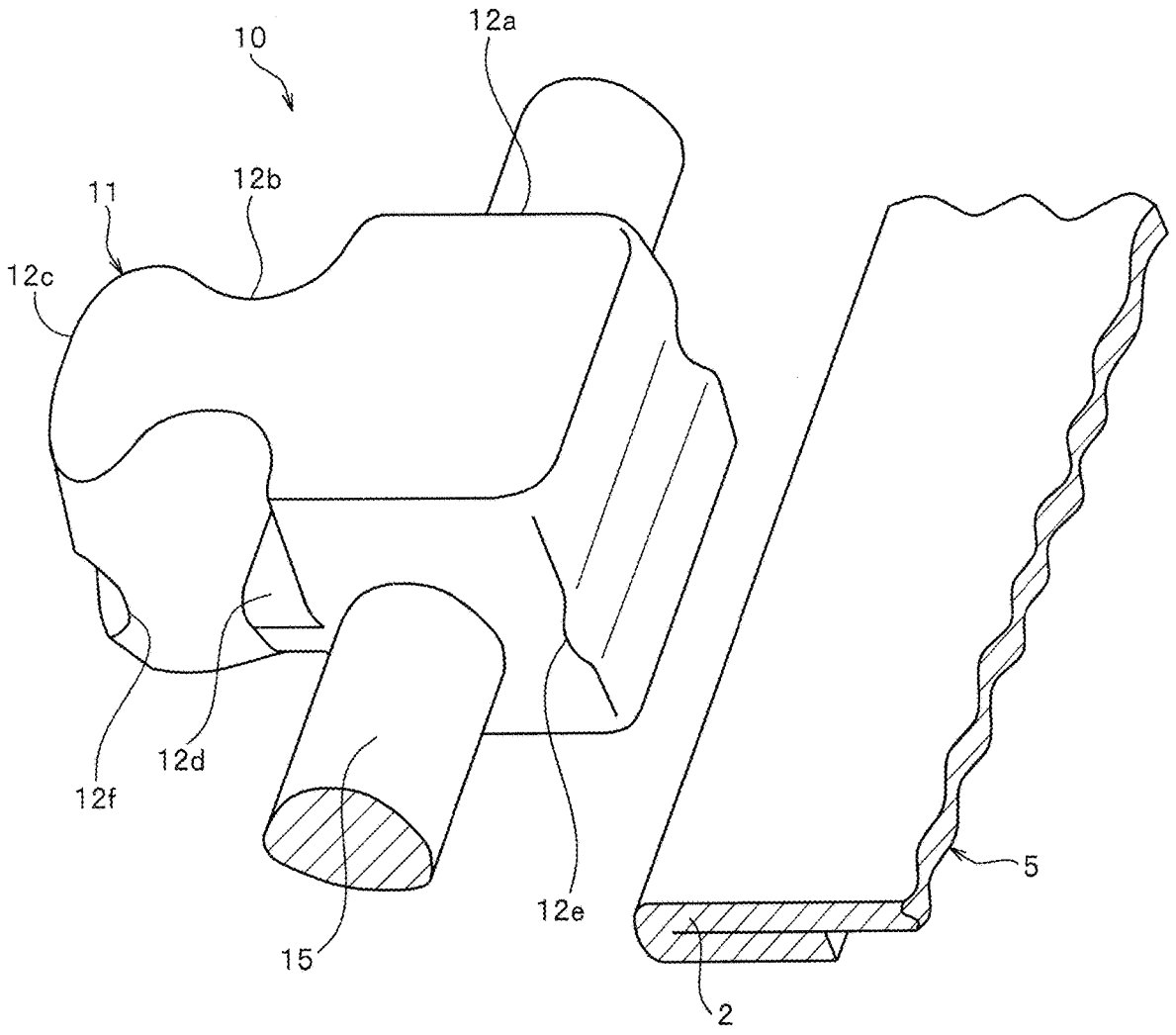
FIG. 5 is a perspective view showing a state before the element member is attached to the fastener attaching edge portion of the product.

In this case, the right and left element attaching edge portions 2 are formed by folding a side edge part which is to be a cut end part of the cloth 5 in a U-shape to the lower surface side, as shown in FIGS. 4 and 5. Since the element attaching edge portion 2 is formed as above, the element attaching edge portion 2 is formed to be thicker locally than other parts of the thin cloth 5, and strength of the element attaching edge portion 2 can be enhanced.

Thereby, even when the sewing thread 7 (upper thread 7*a* and lower thread 7*b* described later) of the sewn portion for fixing 6 pierces the element attaching edge portion 2, as described later, the element attaching edge portion 2 is less likely to be cut by the sewing thread 7, and durability of the element attaching edge portion 2 can be enhanced. Further, since the strength of the element attaching edge portion 2 is enhanced, the element member 10 can be firmly fixed to the element attaching edge portion 2, and a position and a columnure of each fastener element 11 fixed to the element attaching edge portion 2 can be stabilized.

Furthermore, as the side edge part of the cloth 5 is folded in a U-shape, even when a side end edge of the cloth 5 is frayed, the fray is hidden on the back surface side of the element attaching edge portion 2 and is not shown on the outside. Thereby, the slide fastener-attached clothing item 1 has good outer appearance quality (outer appearance). Further, it can be prevented that the coupling of the right and left element rows 3 are worsened and the slidability (smoothness of sliding) of the slider 40 is worsened due to the fray of the side end edge of the cloth 5.

Further, in Embodiment 1, it is also possible that a reinforcement sheet member such as a resin film which is not shown in the drawings is applied and attached to at least one of the top surface and the back surface of the element attaching edge portion 2, and/or to an inside of the side edge part (between the upper and lower folded portion) which is folded in a U-shape of the element attaching edge portion 2, or that it is sewn with the element member 10. The element attaching edge portion 2 can be reinforced as above. In the present invention, the configuration of the cloth 5 of the clothing item is not limited particularly, and can be changed depending on use of the clothing item, etc.

In the conventional slide fastener, an end stop is generally provided adjacent to a front end and a rear end of the element rows in order to prevent the slider from separating from the element rows and falling. In contrast, in Embodiment 1, a cloth piece as a component part of the clothing item is sewn to overlap the front end part and the rear end part of the element rows 3 instead of the end stops provided adjacent to the front end and the rear end of the element rows 3. Thereby, the cloth piece serves as the end stop, and the slider 40 can be prevented from falling from the front end and the rear end of the element rows 3.

It is also possible in the present invention that other means is used in order to prevent the slider 40 from falling. As the means to prevent the slider 40 from falling, for example, it is possible to form the end stops in a predetermined shape at a position adjacent to the front end and the rear end of the element rows 3, to form the end stop by attaching an exclusive end stop part to the fastener element 11 disposed at the front end part and the rear end part of the element rows 3, to bond or weld a resin film to the front end part and the rear end part of the element rows 3, to fold and sew an extended part of the cloth 5 which extends from the front end part and the rear end part of the element rows 3, to sew the front end part and the rear end part of the right and left element rows 3 in the fastener width direction in a state that they are coupled, and to provide a separable rear end stop having an insert pin, a box pin and a box body instead of the end stop.

The element member 10 of Embodiment 1 has a plurality of synthetic resin independent fastener elements 11 (also referred to as solo fastener element) and a fixing member 15 which connects the plurality of fastener elements 11 at constant intervals. The fixing member 15 of Embodiment 1 is a long length string-shaped member having flexibility. The fixing member 15 is a member having a cross-section perpendicular to the length direction in a substantially circle shape, and particularly, it is preferable to be a member having a circular-shaped cross-section and a constant cross-sectional area in the length direction.

As the fixing member 15, a monofilament, a twisted thread (twisted string), or a string body (also referred to as a knitted code) formed by wrapping around a core thread formed of a plurality of drawn multifilaments with a woven bag portion knitted by a plurality of knitted threads can be used.

As long as a plurality of elements can be attached to, the fixing member is not limited particularly. The cross-sectional shape of the fixing member can be arbitrarily changed as necessary. Further, the element member in the present invention may be formed by connecting a plurality of fastener elements by two or more string-shaped fixing members.

The plurality of fastener elements 11 disposed on the element member 10 are lined in a line along the length direction of the element member 10 in a connected state by the fixing member 15 at equal intervals. These fastener elements 11 are formed integrally with the fixing member 15 and covering the whole outer periphery of the fixing member 15 by injection-molding thermoplastic resin such as polyamide, polyacetal, polypropylene, polybutylene terephthalate to a single fixing member 15.

It should be noted that in the present invention, a material of the fastener element is not limited to the synthetic resin as above, and the fastener element can be formed with other synthetic resin or metal. The element member 10 of Embodiment 1 is not limited to the one in which the fastener elements 11 are formed by injection-molding the thermoplastic resin to the fixing member 15, and includes the one formed by fixing such as welding or bonding the fastener elements formed in a predetermined shape by injection-molding thermoplastic resin to the fixing member 15.

Further, the element member of the present invention is not limited to the one in which injection-molded synthetic resin fastener elements 11 are integrally formed to be connected to the fixing member 15 as in Embodiment 1. The element member of the present invention includes an element member formed by metal die casting to a string-shaped fixing member, an element member formed by cutting a linear material having a substantially Y-shaped lateral cross-section (so called "Y-bar") to manufacture an element and attaching the element to the fixing member by pressing deformation, and an element member formed by punching a thin plate-shaped flat plate member to manufacture an element and attaching the element to the fixing member by pressing deformation.

As the element member 10 before being attached to the cloth 5 is shown enlarged in FIG. 5, the synthetic resin fastener element 11 in Embodiment 1 has a body portion 12*a* fixed to the fixing member 15, a neck portion 12*b* extending from the body portion 12*a* continuously in the width direction of the element member 10 and having a constricted shape so that a dimension in the length direction becomes small, a coupling head portion 12*c* extending from the neck portion 12*b* further in the width direction and showing a substantially oval shape in the plan view, and a protruded piece portion 12*d* (also called as shoulder portion) protruded in a thin plate-shape from the neck portion 12*b* in the front and rear direction in the length direction. In such a fastener element 11 of Embodiment 1, a coupling portion 12*g* engaging with a fastener element 11 of the counterpart element member 10 to be coupled is formed of the neck portion 12*b* and the coupling head portion 12*c*.

In this case, an upper surface part and a lower surface part in each of the body portion 12*a*, the neck portion 12*b* and the protruded piece portion 12*d* are disposed perpendicular to the thickness direction and parallel to each other. A dimension in the thickness direction of the neck portion 12*b* (hereinafter, abbreviated to "thickness dimension") and the thickness dimension of the body portion 12*a* are set in the same size. The thickness dimension of the protruded piece portion 12*d* is set to be smaller than the thickness dimension of the body portion 12*a* and the neck portion 12*b*.

The body portion 12*a* of the fastener element 11 has a substantially rectangular parallelepiped shape having a constant thickness dimension. In this case, the body portion 12*a* has an upper surface part and a lower surface part disposed perpendicular to the thickness direction, a front surface part and a rear surface part disposed facing toward the length direction, and a side surface part (cloth-faced side surface part) disposed in the opposite direction of the extending direction of the neck portion 12*b* so as to face to the cloth 5 facing to the cloth 5.

In Embodiment 1, the upper surface part and the lower surface part in the body portion 12*a* are disposed parallel to each other, and the front surface part and the rear surface part of the body portion 12*a* are disposed parallel to each other. It should be noted that in Embodiment 1, it is also possible that the front surface part and the rear surface part of the body portion 12*a* are disposed in a position relationship to be oblique to each other instead of being parallel to each other.

In the body portion 12*a* of Embodiment 1, respective ridge line parts disposed between the upper surface part and the front surface part, the rear surface part or the side surface part, or between the lower surface part and the front surface part, the rear surface part or the side surface part, and the ridge line parts disposed between the front surface part and the side surface part or between the rear surface part and the side surface part are formed to be a smooth curved surface having a round shape so as to be chamfered when seeing a cross-section of each ridge line part. Thereby, at the time, and after, the element member 10 is sewn to the element attaching edge portion 2 of the cloth 5 by forming the sewn portion for fixing 6 with a zigzag stitch sewing machine, as described later, the sewing thread 7 of the sewn portion for fixing 6 can be less likely to be damaged even when the sewing thread 7 of the sewn portion for fixing 6 is contacted with the body portion 12*a* of the fastener element 11.

Further, in the side surface part (cloth-faced side surface part) of the body portion 12*a* disposed to face to the cloth 5, an insertion concave portion 12*e* to which a part of the element attaching edge portion 2 of the cloth 5 is inserted is provided along the length direction of the element member 10. The insertion concave portion 12*e* is concaved at the side surface part of the body portion 12*a* at a size corresponding to a thickness dimension of the element attaching edge portion 2 of the cloth 5. A top surface of the insertion concave portion 12*e* is formed in a smooth curved-surface shape with respect to the thickness dimension. The element member 10 is fixed to the element attaching edge portion 2 with the sewn portion for fixing 6 in a state that the element attaching edge portion 2 of the cloth 5 is inserted to the insertion concave portion 12*e* provided in each fastener element 11, thereby each fastener element 11 can be fixed firmly and stably to the element attaching edge portion 2 in a predetermined aspect.

In such a body portion 12*a* of the fastener element 11, a fixing member 15 is penetrated along the length direction, and is held in a state that the outer peripheral surface of the fixing member 15 is wrapped by the body portion 12*a* not to be exposed outside. In this case, the fixing member 15 is held at a center part in the thickness direction of the body portion 12*a*.

A concave groove portion 12*f* is formed at a top end part (tip end part) of the coupling head portion 12*c* in the fastener element 11 at a center part in the thickness direction along the length direction. The concave groove portion 12*f* is formed so that, when the right and left element rows 3 are coupled, the protruded piece portion 12*d* of the counterpart fastener element 11 to be coupled can be fit in. Therefore, the maximum value of the thickness dimension of the concave groove portion 12*f* is set larger than the thickness dimension of the protruded piece portion 12*d* of the fastener element 11.

As each fastener element 11 has the concave groove portion 12*f* of the coupling head portion 12*c* and the front and rear protruded piece portions 12*d* as above, when the right and left fastener elements 11 are coupled, relative position displacement in the upper and lower direction can be effectively prevented. In the present invention, a shape of the fastener element 11 is not particularly limited, and can be changed randomly.

The element member 10 of Embodiment 1 as mentioned above is lined at a position adjacent to an outside in the width direction with respect to the element attaching edge portion 2 of the cloth 5 and fixed with the sewn portion for fixing (sewing line for fixing) 6. In this case, the sewn portion for fixing 6 is formed by sewing with a zigzag stitch sewing machine, and formed to be bent in a zigzag shape with respect to the length direction with lock stitches. With the sewn portion for fixing 6, the element member 10 is fixed to the element attaching edge portion 2 in a state that the body portion 12*a* of each fastener element 11 is contacted with the element attaching edge portion 2 of the cloth 5.

The zigzag stitch sewing machine here means a sewing machine which can sew the cloth 5 and others with lock stitches in a zigzag shape while swinging a sewing needle along a crossing direction which crosses in a feeding direction of the sewing machine. The swing of the sewing needle in the zigzag stitch sewing machine is sometimes referred to as zigzag swing. By using such a zigzag stitch sewing machine and conducting sewing by setting coordinate data in X-coordinate (a position in the feeding direction) and Y-coordinate (a position in the crossing direction) which become a needle location, for example, the sewn portion for fixing 6 formed after sewing can be bent easily to be in a zigzag shape in the crossing direction with respect to the feeding direction of the zigzag stitch sewing machine.

In Embodiment 1, the sewing thread 7 of the sewn portion for fixing 6 formed by lock stitching has an upper thread (needle thread) 7*a* running on a top surface (first surface) of the element attaching edge portion 2 and contacting with a half part on the top surface side of the fixing member 15 and a lower thread (bobbin thread) 7*b* running on the back surface (second surface) of the element attaching edge portion 2 and contacting with a half part on the back surface side of the fixing member 15. In this case, since the sewn portion for fixing 6 is formed by lock stitching, the upper thread 7*a* and the lower thread 7*b* are disposed in position relations plane-symmetrical to each other except a part where both cross.

A conventional general sewing thread is used for the upper thread 7*a* and the lower thread 7*b* of the lock stitches. Further, the upper thread 7*a* and the lower thread 7*b* in the lock stitches cross (interlace) each other at piercing positions (first piercing position 18*a* and second piercing position 18*b*, described later) that the sewn portion for fixing 6 pierces the element attaching edge portion 2 and at a position contacting with the outer peripheral surface of the fixing member 15.

The upper thread 7*a* and the lower thread 7*b* of the sewn portion for fixing 6 cross each other at a position between the upper thread 7*a* running on the top surface of the element attaching edge portion 2 and the lower thread 7*b* running on the back surface of the element attaching edge portion 2 regarding the thickness direction. Particularly in Embodiment 1, the upper thread 7*a* and the lower thread 7*b* cross each other at a position of a center part in the thickness direction in the element attaching edge portion 2. Thereby, the crossed part of the upper thread 7*a* and the lower thread 7*b* at the piercing position can be protected by the element attaching edge portion 2 as well as can be less likely to be seen from the outside. It should be noted that the crossing position of the upper thread 7*a* and the lower thread 7*b* in the thickness direction can be easily changed by controlling tension of the upper thread 7*a* and the lower thread 7*b* of the zigzag stitch sewing machine.

The sewn portion for fixing 6 in Embodiment 1 is formed by interlacing the upper thread 7*a* and the lower thread 7*b* with lock stitches using the zigzag stitch sewing machine as above. Thereby, the sewn portion for fixing 6 can pierces the element attaching edge portion 2 of the cloth 5 and support the fixing member 15 of the element member 10 so as to wrap it. Therefore, the element member 10 is attached and fixed easily and stably to the element attaching edge portion 2 of the cloth 5 with the sewn portion for fixing 6.

In Embodiment 1, it is also possible that at the time the upper thread 7*a* and the lower thread 7*b* of the sewn portion for fixing 6 pierce the element attaching edge portion 2 of the cloth 5, the upper thread 7*a* and the lower thread 7*b* pierce and hold the fixing member 15 of the element member 10, too, thereby the element member 10 is attached to the element attaching edge portion 2 of the cloth 5.

Further, since the sewn portion for fixing 6 is formed by using a zigzag stitch sewing machine, it can be effectively prevented that the upper thread 7*a* and the lower thread 7*b* of the sewn portion for fixing 6 after sewing overlap the top surface (upper surface) and the back surface (lower surface) of the fastener element 11. Thereby, defects due to the overlap of the upper thread 7*a* and the lower thread 7*b* of the sewn portion for fixing 6 with the fastener element 11 such as looseness of the upper thread 7*a* and the lower thread 7*b*, lowered smooth coupling of the element rows 3 (ease of coupling) and lowered slidability of the slider 40 can be suppressed.

The sewn portion for fixing 6 of Embodiment 1 has a unit running area 17 in which the upper thread 7*a* and the lower thread 7*b* of the lock stitches run from an outer peripheral crossing position to cross each other on an outer peripheral surface of a fixing member 15 to a next outer peripheral crossing position to cross each other on the outer peripheral surface of the fixing member 15 with respect to one fastener element 11. The sewn portion for fixing 6 is formed by repeating a predetermined pattern of stitches in the unit running area 17 per fastener element 11 in the length direction. In this case, each unit running area 17 forming the sewn portion for fixing 6 of Embodiment 1 has two piercing positions at which the sewn portion for fixing 6 pierces the element attaching edge portion 2.

The unit running area 17 of Embodiment 1 will be described here in detail referring to FIG. 2. The upper thread 7*a* and the lower thread 7*b* of the sewn portion for fixing 6 in Embodiment 1 has a first running portion 17*a* disposed from the outer peripheral crossing position on which the upper thread 7*a* and the lower thread 7*b* cross on an outer peripheral surface of the fixing member 15 to a first piercing position 18*a*, a second running portion 17*b* disposed from the first piercing position 18*a* to a next second piercing position 18*b*, and a third running portion 17*c* disposed from the second piercing position 18*b* to a next outer peripheral crossing position.

In this case, the first running portion 17*a* is formed such that the upper thread 7*a* (or the lower thread 7*b*) runs from the outer peripheral crossing position as above to a position corresponding to the side surface part of the fastener element 11 in the width direction along the width direction (or substantially width direction), and further runs obliquely to the width direction to the first piercing position 18*a*. In this case, a boundary between a part running along the width direction and a part running obliquely to the width direction in the first running portion 17*a* may contact the body portion 12*a* of the fastener element 11, in some cases.

The second running portion 17*b* is formed such that the upper thread 7*a* (or the lower thread 7*b*) runs along the length direction of the element member 10 between the first piercing position 18*a* and the second piercing position 18*b*. The third running portion 17*c* is formed such that the upper thread 7*a* (or the lower thread 7*b*) runs obliquely to the width direction from the second piercing position 18*b* to a position corresponding to the side surface part of the fastener element 11 in the width direction, and further runs to the outer peripheral crossing position along the width direction (or substantially width direction). In this case, the boundary between a part running obliquely to the width direction and the part running along the width direction of the third running portion 17*c* may contact the body portion 12*a* of the fastener element 11, in some cases.

When the sewn portion for fixing 6 is formed such that the upper thread 7*a* and the lower thread 7*b* run as above, in a plan view viewed from the upper direction of the element member 10 and the element attaching edge portion 2 of the cloth 5 (or a bottom view viewed from the lower direction), as shown in FIG. 2, the side surface part of the fastener element 11 contacting the element attaching edge portion 2 (cloth-faced side surface part) and a part of the sewn portion for fixing 6 which is formed further inside of the side surface part of the fastener element 11 in the cloth 5 are disposed to show an isosceles trapezoid shape.

In Embodiment 1 in particular, the sewn portion for fixing 6 is formed so that the first piercing position 18*a* and the second piercing position 18*b* which pierce the element attaching edge portion 2 of the cloth 5 are separated from the cloth-faced side surface part of each fastener element 11 toward an inside of the cloth 5 in the width direction (in other words, an opposite direction of a direction facing to a counterpart fastener element 11 to be coupled). That is, a constant interval is provided between the first and second piercing positions 18*a*, 18*b* of the sewn portion for fixing 6 and the cloth-faced side surface part of each fastener element 11 regarding the width direction of the element member 10.

In this case, a dimension (separation distance) W between the first and second piercing positions 18*a*, 18*b* of the element member 10 and a position of the cloth-faced side surface part of each fastener element 11 in the width direction is specifically set at 0.4 mm or more, and preferably at 0.8 mm or more. Further in this case, the above dimension (separation distance) W is preferably set to be equal to or larger than the thickness dimension of the cloth 5.

Since the first and second piercing positions 18*a*, 18*b* of the sewn portion for fixing 6 are set at positions as above, and the upper thread 7*a* and the lower thread 7*b* of the sewn portion for fixing 6 can be less likely to overlap the top surface and the back surface of the fastener element 11. Further, an interval in the width direction between the first and second piercing positions 18*a*, 18*b* and a side end edge of the element attaching edge portion 2 can be secured in a large degree. Thereby, strength of the element attaching edge portion 2 can be secured easily and stably, and damages of the cloth 5 such that the cloth 5 is cut from the first or second piercing positions 18*a*, 18*b* to a side end edge of the element attaching edge portion 2 rubbed by the upper thread 7*a* and the lower thread 7*b* can be less likely to occur.

Meanwhile, the dimension (separation distance) W between the first and second piercing positions 18*a*, 18*b* of the sewn portion for fixing 6 and the cloth-faced side surface part of each fastener element 11 is set at 30 mm or less, preferably 10 mm or less and more preferably 5 mm or less. As it is set at such a size, the element member 10 can be stably fixed to the element attaching edge portion 2 of the cloth 5 with the sewn portion for fixing 6, and the position displacement of the fastener elements 11 can be effectively prevented.

Further in Embodiment 1, the dimension (separation distance) W between the first and second piercing positions 18*a*, 18*b* of the sewn portion for fixing 6 and the position of the cloth-faced side surface part of each fastener element 11 in the width direction is set larger than a dimension in the width direction (see FIG. 4) of a flange portion 45 of the slider 40 to be attached as described later. That is, the first and second piercing positions 18*a*, 18*b* of the sewn portion for fixing 6 in Embodiment 1 are disposed to be an outside of a position of the flange portion 45 of the slider 40 attached to the element rows 3.

A relation between the sewn portion for fixing 6 and the flange portion 45 of the slider 40 will be described here in detail. At the right and left element attaching edge portions 2 of the cloth 5 in Embodiment 1, as shown in FIG. 4, a flange-faced area (slider-faced area) 2*a* facing to the flange portion 45 of the slider 40 sliding along the element rows 3 is continuously disposed on both sides of the upper surface (top surface) and the lower surface (back surface) of the element attaching edge portion 2 along the length direction (length direction of the element member 10).

The sewn portion for fixing 6 of Embodiment 1 is formed to be bent in a zigzag shape in the width direction with respect to the length direction as above (see FIG. 2). In this case, the upper thread 7*a* and the lower thread 7*b* which is the sewing thread 7 of the sewn portion for fixing 6 is exposed on the upper surface and the lower surface of the element attaching edge portion 2, and is disposed across the flange-faced area 2*a* of the element attaching edge portion 2. The upper thread 7*a* and the lower thread 7*b* exposed across the flange-faced area 2*a* form the protective part protecting the element attaching edge portion 2 from contact with the flange portion 45 of the slider 40. In this case, the sewn portion for fixing 6 formed of the sewing thread 7 to be bent in a zigzag shape is disposed to have a larger dimension in the width direction than the flange-faced area 2*a* of the element attaching edge portion 2 as shown in FIG. 4. In the present invention, as long as the sewn portion for fixing 6 is disposed on an entire flange-faced area 2*a* in the width direction of the element attaching edge portion 2, the dimension in the width direction can be made to smaller than in a case of Embodiment 1. The sewing thread 7 (upper thread 7*a* and lower thread 7*b*) of the sewn portion for fixing 6 which serves as the protective part can make the flange portion 45 of the slider 40 difficult to directly slide-contact (or not to slide-contact) with the element attaching edge portion 2 of the cloth 5.

Thereby, even when the sliding operation of the slider 40 is repeated, the element attaching edge portion 2 is less likely to be worn out by the flange portion 45 of the slider 40. As a result, damages of the element attaching edge portion 2 being partially thin or cut due to sliding of the slider 40 can be suppressed, and the element attaching edge portion 2 is less likely to be damaged by the slider 40. Therefore, durability of the element attaching edge portion 2 can be improved.

In Embodiment 1, the first piercing position 18*a* and the second piercing position 18*b* of the sewn portion for fixing 6 are disposed in a region corresponding to a forming area of the body portion 12*a* of the fastener element 11 regarding the length direction of the element member 10, as shown in FIG. 2. Since the first piecing position 18*a* and the second piercing position 18*b* are disposed in the above region, the element member 10 can be firmly fixed to the element attaching edge portion 2 of the cloth 5 with the sewn portion for fixing 6, and a position of each fastener element 11 in the length direction of the element member 10 can be less likely to be displaced with respect to the element attaching edge portion 2.

In the slide fastener-attached clothing item 1 in Embodiment 1, an auxiliary sewn portion 8 is continuously formed to fasten the upper thread 7*a* and the lower thread 7*b* of the sewn portion for fixing 6 not to be loosened in an area between the position of the cloth-faced side surface part of each fastener element 11 and the first piercing position 18*a* and the second piercing position 18*b* of the sewn portion for fixing 6 in the width direction.

Particularly, the auxiliary sewn portion 8 of Embodiment 1 is linearly formed by lock stitching which interlaces an auxiliary upper thread (needle thread) and an auxiliary lower thread (bobbin thread) using a sewing machine along the length direction of the element member 10. As the auxiliary sewn portion 8 is formed by lock stitching, the auxiliary sewn portion 8 can be easily and stably formed, and the upper thread 7*a* and the lower thread 7*b* of the sewn portion for fixing 6 can be stably pressed (fastened) as described later. Therefore, the auxiliary sewn portion 8 can also be referred to as a sewn portion for fastening.

In this case, the auxiliary upper thread and the auxiliary lower thread of the auxiliary sewn portion 8 cross (interlace) each other at a piercing position on which the auxiliary sewn portion 8 pierces the element attaching edge portion 2, and at a position in a center part in the thickness direction of the element attaching edge portion 2. It should be noted that the crossing position of the auxiliary upper thread and the auxiliary lower thread in the thickness direction can be changed by controlling tension of the auxiliary upper thread and the auxiliary lower thread in the sewing machine.

The piercing position that the auxiliary sewn portion 8 pierces the element attaching edge portion 2 is disposed in an area in the width direction between the cloth-faced side surface part of the fastener element 11 and the piercing position (first and second piercing positions 18*a*, 18*b*) of the sewn portion for fixing 6. In other words, it is disposed in an area which overlaps the first running portion 17*a* and third running portion 17*c* in the sewn portion for fixing 6, as mentioned above. The auxiliary upper thread of the auxiliary sewn portion 8 crosses the upper thread 7*a* of the sewn portion for fixing 6 and the auxiliary lower thread of the auxiliary sewn portion 8 crosses the lower thread 7*b* of the sewn portion for fixing 6, respectively in the area.

As the auxiliary sewn portion 8 is formed as above, the upper thread 7*a* and the lower thread 7*b* of the sewn portion for fixing 6 can be pressed vertically by the auxiliary upper thread and the auxiliary lower thread toward the element attaching edge portion 2 (in other words, inward in the thickness direction). Thereby, the upper thread 7*a* and the lower thread 7*b* of the sewn portion for fixing 6 can be fastened by the auxiliary sewn portion 8, and tension can be applied thereto.

Therefore, even when the upper thread 7*a* and the lower thread 7*b* of the sewn portion for fixing 6 are loosened, the looseness can be eliminated by forming the auxiliary sewn portion 8. Further, the looseness of the upper thread 7*a* and the lower thread 7*b* in the sewn portion for fixing 6 can also be effectively prevented. Accordingly, the element member 10 can be fixed more firmly with the sewn portion for fixing 6.

Furthermore in Embodiment 1, at least a part of the auxiliary upper thread and the auxiliary lower thread which are the sewing thread 7 of the auxiliary sewn portion 8 is disposed as the protective part protecting the element attaching edge portion 2 from contact with the flange portion 45 of the slider 40 along the length direction. Since at least a part of the sewing thread 7 of the auxiliary sewn portion 8 is disposed in the flange-faced area 2*a*, when the slider 40 is operated to slide, the flange portion 45 of the slider 40 is less likely to be slide-contacted with the element attaching edge portion 2 of the cloth 5. Therefore, the element attaching edge portion 2 can be protected more stably from the flange portion 45 of the slider 40. Thus, the durability of the element attaching edge portion 2 can be further enhanced.

Further in Embodiment 1, the piercing position that the auxiliary sewn portion 8 pierces the element attaching edge portion 2 is disposed, as shown in FIG. 4, in an area in the width direction between the cloth-faced side surface part of the fastener element 11 and the first piercing position 18*a* and the second piercing position 18*b* of the sewn portion for fixing 6, and further, is disposed in a center part in the width direction between the cloth-faced side surface part of the fastener element 11 and the piercing position of the sewn portion for fixing 6, or at a position between the center part and the first piercing position 18*a* and the second piercing position 18*b* of the sewn portion for fixing 6. As the piercing position of the auxiliary sewn portion 8 is set as above, when the upper thread 7*a* and the lower thread 7*b* of the sewn portion for fixing 6 are pressed by the auxiliary sewn portion 8, the sewn portion for fixing 6 can be effectively prevented from being loosened.

It should be noted that although the auxiliary sewn portion 8 of Embodiment 1 is formed by straight lock stitching along the length direction, the auxiliary sewn portion 8 can be formed by stitching other than lock stitching such as multi-thread chain stitching in the present invention, as long as the auxiliary sewn portion 8 can press the upper thread 7*a* and the lower thread 7*b* of the sewn portion for fixing 6 toward the element attaching edge portion 2.

The slider 40 to be attached to the element rows 3 in Embodiment 1 has a slider body 41 and a tab 42 held by the slider body 41, as schematically shown in FIGS. 1 and 4. The slider body 41 of Embodiment 1 has an upper blade 43, a lower blade 44 disposed separately to be parallel to the upper blade 43, a connecting column (not shown) connecting front end parts (shoulder mouth side end parts) of the upper blade 43 and the lower blade 44, upper and lower flange portions 45 disposed at right and left side edge parts of the upper blade 43 and the lower blade 44, and a tab attaching portion 46 disposed on an upper surface of the upper blade 43 and holding the tab 42.

In the front end part of the slider body 41, right and left shoulder mouths are formed interposing the connecting column, and a rear mouth is formed at a rear end part of the slider body 41. Between the upper blade 43 and the lower blade 44, an element guide path communicating the right and left shoulder mouths and the rear mouth, and having a substantially Y-shape is formed. Further, between the upper and lower flange portions 45 of the slider body 41, an insertion gap to which the element attaching edge portion 2 of the cloth 5 is inserted is formed parallel to the upper blade 43 and the lower blade 44. Using the slider 40 having the above mentioned structure enables to smooth coupling and separating of the right and left element members 10 directly fixed to the element attaching edge portion 2 of the cloth 5 of the clothing item 1.

Next, a manufacturing method of a slide fastener-attached clothing item 1 in Embodiment 1 having the element member 10 as mentioned above will be explained.

First, a right and left pair of element members 10 and the cloth 5 for clothing item are respectively prepared. The element member 10 of Embodiment 1 is manufactured by injection-molding synthetic resin directly to one string-shaped fixing member 15, and forming a plurality of fastener elements 11 having a predetermined shape at regular intervals, as described above.

In the meantime, a cloth 5 for clothing item which becomes a fastener-attached member is manufactured by weaving or knitting separately from the element member 10. In this time, if waterproof property needs to be added to the cloth 5, for example, it is also possible to apply synthetic resin or put a resin film on the woven or knitted cloth 5.

Subsequently, the manufactured cloth 5 is cut to be a predetermined shape corresponding to front bodies of the clothing item 1, and the cloth 5 (cloth parts) serving as a fastener attached member for a right and left pair of the front bodies is manufactured. Further, the element attaching edge portion 2 for attaching the element member 10 is formed on the cloths 5 by folding a cut side edge part in a U-shape in the right and left cloths 5. In this case, the element attaching edge portions 2 formed respectively on the cloth 5 of the right and left pair of front bodies, are provided on a position disposed facing to each other when the clothing item is manufactured.

Next, using the element member 10 manufactured as above and the cloths 5 which are cut in a predetermined shape and on which the element attaching edge portion 2 is formed, clothes component parts with the element member 10 is manufactured.

First, as the first sewing step, the element member 10 is sewn to the element attaching edge portion 2 of the cloth 5 using a zigzag stitch sewing machine as shown in FIG. 5, for example. In this case, when sewing is conducted to the element member 10 and the element attaching edge portion 2 of the cloth 5 using a zigzag stitch sewing machine in which coordinate data of needle locations are set, the sewn portion for fixing 6 as shown in FIG. 2 etc. is formed, and the element member 10 can be sewn and fixed to the element attaching edge portion 2 of the cloth 5 with the sewn portion for fixing 6.

Next, as the second sewing step, the auxiliary sewn portion 8 is formed by sewing with a single needle lock stitch sewing machine with respect to the element attaching edge portion 2 of the cloth 5 to which the element member 10 is fixed with the sewn portion for fixing 6. Thereby, the auxiliary sewn portion 8 formed of the above-mentioned linear lock stitches can be stably formed at a predetermined position of the element attaching edge portion 2 in which the sewn portion for fixing 6 is formed.

As a result, the upper thread 7*a* and the lower thread 7*b* of the sewn portion for fixing 6 can be pressed toward the element attaching edge portion 2 with the auxiliary sewn portion 8, thereby the element member 10 can be fixed to the element attaching edge portion 2 more firmly. Thus, the right and left cloth parts of the clothing item having the element member 10 in which the element member 10 is fixed to the element attaching edge portion 2 with the sewn portion for fixing 6 and the auxiliary sewn portion 8, as shown in FIGS. 2 to 4 is manufactured. In Embodiment 1, in addition to the above-mentioned right and left pair of the cloth component parts, other cloth component parts (not shown) constituting right and left sleeve portions and a back body in the clothing item 1 are manufactured and prepared.

Thereafter, the clothing item is assembled by combining each manufactured cloth component parts by sewing each other and the like. Further, the slider 40 is slidably attached to the element rows 3 formed by fixing the element member 10 to the element attaching edge portion 2 of the cloth 5. Thereby, the slide fastener-attached clothing item 1 as shown in FIG. 1 is stably manufactured.

In the slide fastener-attached clothing item 1 of Embodiment 1 manufactured as above, a part of the cloth 5 of the clothing item 1 not only constitutes the clothing item 1, but also functions as a fastener tape in a conventional slide fastener. Therefore in the slide fastener-attached clothing item 1 of Embodiment 1, the function of the slide fastener can be obtained in a shape omitting the fastener tape (in other words, a shape of the slide fastener without the fastener tape) which had been an essential constituent parts in the conventional slide fastener. Thereby, a manufacturing cost of the slide fastener-attached clothing item 1 (material cost in particular) can be decreased. Further, weight of the slide fastener-attached clothing item 1 can be reduced, and flexibility of the clothing item 1 can be improved. In the case of the clothing item 1 of Embodiment 1, in particular, flexibility of the cloth 5 in the front placket portion of the clothing item 1 in the top and back direction can be enhanced.

Further in Embodiment 1, the element member 10 can be fixed directly to the cloth 5 after a desired function such as waterproof property or water-repellent property, for example, is applied to the cloth 5. Therefore, it becomes possible to easily manufacture a high quality slide fastener-attached clothing item 1 having waterproof property or water-repellent property.

Further, in the slide fastener-attached clothing item 1 of Embodiment 1, the protective part protecting the element attaching edge portion 2 of the clothing item 1 from the flange portion 45 of the slider 40 is formed of the sewing thread (upper thread 7*a* and lower thread 7*b*) 7 of the sewn portion for fixing 6 and the sewing thread (auxiliary upper thread and auxiliary lower thread) 7 of the auxiliary sewn portion 8. Thereby, even when the sliding operation of the slider 40 is repeated, wear-out of the element attaching edge portion 2 of the clothing item caused by sliding of the slider 40 is suppressed, and the cloth 5 is less likely to be damaged. As a result, durability of the clothing item 1 (durability in the element attaching edge portion 2 of the cloth 5, in particular) can be improved.

It should be noted that in manufacturing the slide fastener-attached clothing item 1 of the above-mentioned Embodiment 1, the element member 10 is fixed by sewing after the cloth parts for the front body are cut in a predetermined shape. In the present invention, however, it is also possible to manufacture the cloth component parts having the element member 10 by fixing the element member 10 at a predetermined position by sewing with respect to the cloth 5 before cutting, and thereafter cutting the cloth 5 with the element member 10 in a predetermined shape.

In the element member 10 of Embodiment 1, in order to firmly fix the elements 11 to the element attaching edge portion 2 of the cloth 5 in a predetermined columnure, an insertion concave portion 12*e* to which a part of the element attaching edge portion 2 of the cloth 5 can be inserted is provided on the side surface part of each fastener element 11, as described above. In the present invention, however, it is also possible to manufacture an element member by forming a plurality of fastener elements in which the insertion concave portion 12*e* is not provided on the side surface part are integrally formed on the fixing member 15.

In the above-mentioned Embodiment 1, the sewn portion for fixing 6 formed with a zigzag stitch sewing machine is formed by repeating a unit running area 17 having a first running portion 17*a* and a third running portion 17*c* which has an oblique part in which the upper thread 7*a* and the lower thread 7*b* run obliquely with respect to the width direction, and the second running portion 17*b* in which the upper thread 7*a* and the lower thread 7*b* run along the length direction. Particularly in this case, the sewn portion for fixing 6 is formed so that the cloth-faced side surface part of the fastener element 11 and a part of the sewn portion for fixing 6 which is formed on an inside of the side surface part of the fastener element 11 in the cloth 5 show an isosceles trapezoidal-shape.

However, the shape of the unit running area 17 of the sewn portion for fixing 6 is not limited thereto, and the sewn portion for fixing can be formed in another shape using the zigzag stitch sewing machine. As shown in the sewn portion for fixing 6*a* according to a modification example in FIG. 6, for example, the unit running area 19 of the sewn portion for fixing 6*a* may have a first running portion 19*a* in which the upper thread 7*a* and the lower thread 7*b* run linearly from an outer peripheral crossing position to cross on the outer peripheral surface of the fixing member 15 to the first piercing position 18*a* along the width direction, a second running portion 19*b* in which the upper thread 7*a* and the lower thread 7*b* run linearly from the first piercing position 18*a* to a next second piercing position 18*b* along the length direction, and a third running portion 19*c* in which the upper thread 7*a* and the lower thread 7*b* run linearly from the second piercing position 18*b* to the next outer peripheral crossing position along the width direction.

Figure 6:
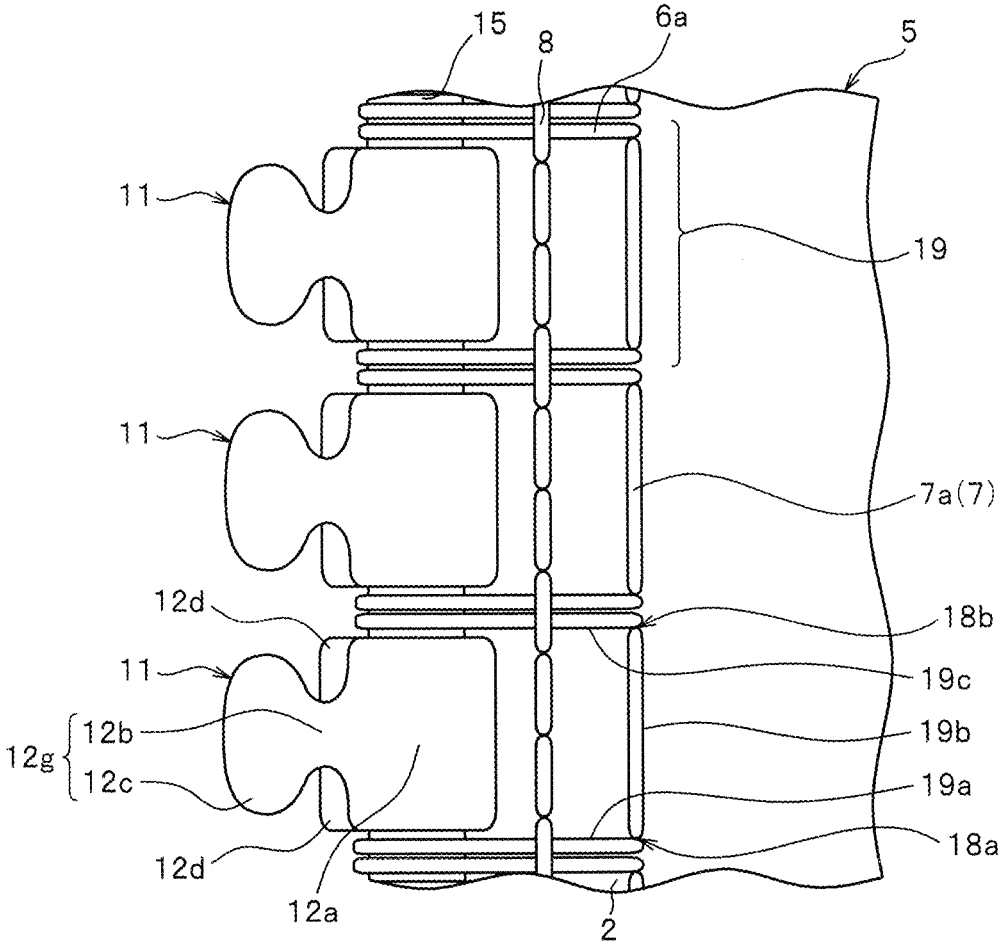
FIG. 6 is a plan view showing a main part of the slide fastener-attached product according to a modification example of Embodiment 1.

In a case that the sewn portion for fixing 6*a* is formed by repeating the unit running area 19 as shown in FIG. 6, the sewn portion for fixing 6*a* pierces the element attaching edge portion 2 of the cloth 5 and can support the fixing member 15 of the element member 10 so as to wrap at least a part of it, thereby the element member 10 can be firmly and stably fixed to the element attaching edge portion 2 of the cloth 5. In addition, since the sewn portion for fixing 6*a* is formed along the length direction and the width direction, appearance and design of the slide fastener-attached clothing item 1 can be enhanced.

Embodiment 2

Figure 7:
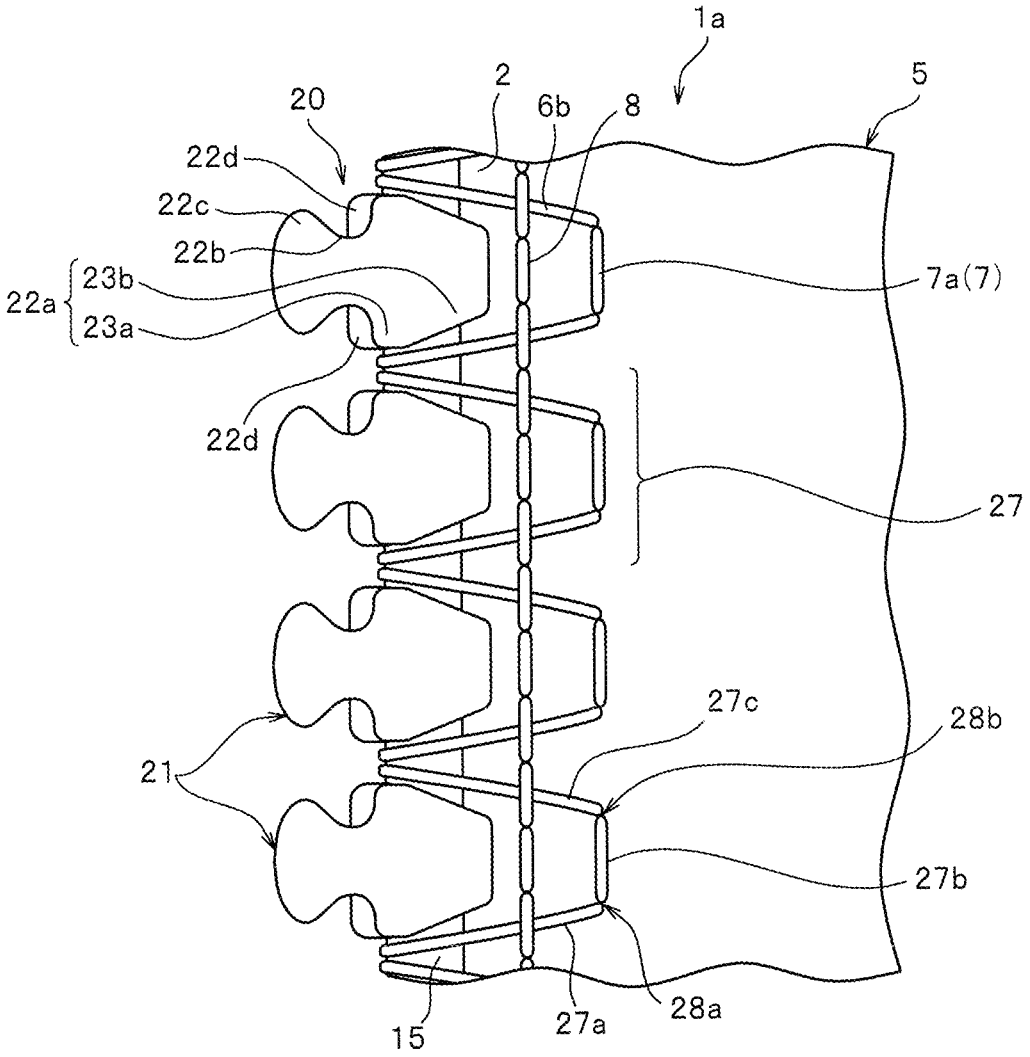
FIG. 7 is a plan view showing a main part of the slide fastener-attached product according to Embodiment 2 of the present invention.
Figure 8:
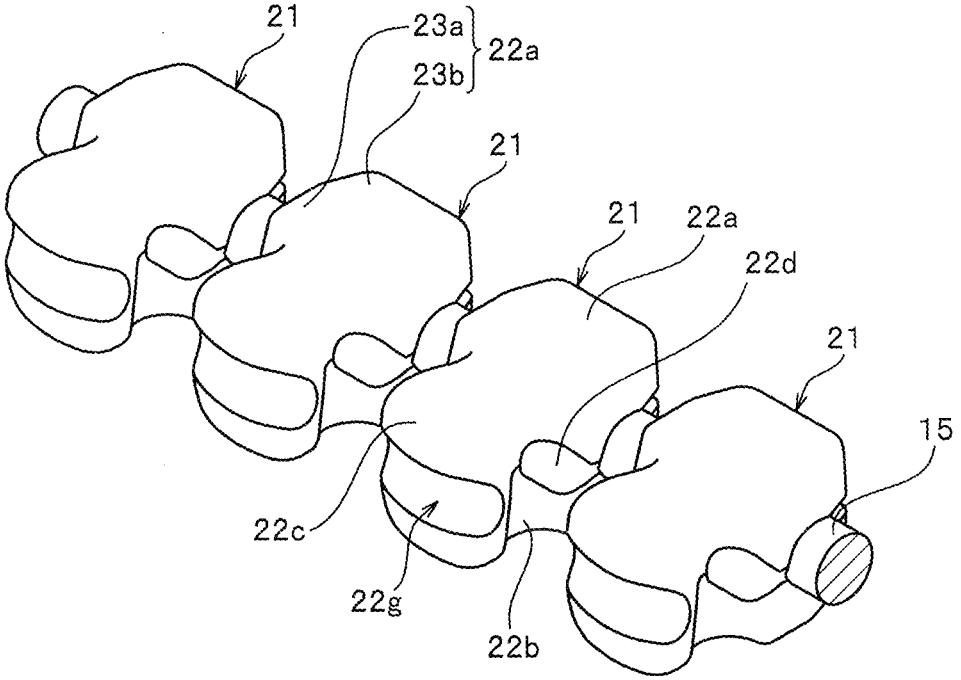
FIG. 8 is a perspective view showing the element member of Embodiment 2.

FIG. 7 is a plan view showing a main part of the slide fastener-attached clothing item according to Embodiment 2 of the present invention. FIG. 8 is a perspective view showing the element member of Embodiment 2.

A slide fastener-attached clothing item 1*a* of Embodiment 2 is formed to be different from the slide fastener-attached clothing item 1 of Embodiment 1 as mentioned above in a shape of a fastener element 21 and a shape of a stitch of a sewn portion for fixing 6*b*. Other than that, the slide fastener-attached clothing item 1*a* of Embodiment 2 is formed as same as the slide fastener-attached clothing item 1 of Embodiment 1 as above.

Accordingly, in Embodiment 2, parts and members having substantially same configurations with those in the above Embodiment 1 are represented with the same reference numerals, and explanations thereof are omitted. Also in Embodiment 3 and others, described later, parts and members having substantially same configurations with those in the aforementioned Embodiments are represented with the same reference numerals, and explanations thereof are omitted.

The element member 20 of Embodiment 2 is formed by fixing a plurality of synthetic resin fastener element 21 at a constant interval to the fixing member 15.

The fastener element 21 of Embodiment 2 has a body portion 22*a* fixed to the fixing member 15 so as to wrap the fixing member 15, a neck portion 22*b* extending from the body portion 22*a*, a coupling head portion 22*c* further extending from the neck portion 22*b*, and a protruded piece portion 22*d* protruded from the neck portion 22*b* frontward and rearward in a thin plate shape. On a tip end part of the coupling head portion 22*c*, a concave groove portion 22*f* is formed along the length direction. In this case, the neck portion 22, the coupling head portion 22*c*, the protruded piece portion 22*d* and the concave groove portion 22*f* of the fastener element 21 are formed substantially as same as the fastener element 11 in the above-mentioned Embodiment 1. Therefore, also in the fastener element 21 of Embodiment 2, a coupling portion 22*g* engaging with the fastener element 11 on a coupling counterpart side is formed of the neck portion 22*b* and the coupling head portion 22*c*.

The body portion 22*a* of Embodiment 2 has an upper surface part and a lower surface part disposed perpendicular to the thickness direction, a front surface part and a rear surface part disposed facing toward the length direction, and a side surface part (cloth-faced side surface part) facing to the cloth 5. The upper surface part and the lower surface part of the body portion 22*a* are disposed parallel to each other, and the body portion 22*a* has a constant thickness dimension. In the side surface part (cloth-faced side surface part) of the body portion 22*a*, a insertion concave portion (not shown) in which a part of the element attaching edge portion 2 of the cloth 5 is inserted is provided along the length direction of the element member 20.

The body portion 22*a* of Embodiment 2 has, in a plan view the fastener element 21, a body tip end portion 23*a* connecting the neck portion 22*b* and having a constant size of a length dimension (dimension of the element member 20 in the length direction) between the front surface part and the rear surface part of the body portion 22*a*, and a tapered portion 23*b* extending from the body tip end portion 23*a* toward a side of the element attaching edge portion 2. The tapered portion 23*b* is formed such that the length dimension of the body portion 22*a* between the front surface part and the rear surface part is gradually decreased at a constant rate as approaching to the element attaching edge portion 2 (or with distance from the neck portion 22*b*).

The body portion 22*a* of Embodiment 2 has the body tip end portion 23*a* and the tapered portion 23*b* as mentioned above, and the front surface part and the rear surface part disposed at the body portion 22*a* has a parallel part parallel to the element member 20 in the width direction and an oblique part in a flat surface shape disposed to be oblique with respect to the width direction.

In Embodiment 2, as the tapered portion 23*b* is provided on the body portion 22*a*, the sewing thread 7 (upper thread 7*a* and lower thread 7*b*) of the sewn portion for fixing 6*b* which fixes the element member 20 is less likely to overlap the fastener element 21 than in a case of the fastener element 11 of Embodiment 1 as mentioned above. In this case, the tapered portion 23*b* is provided in a region of 10% or more and 90% or less of the entire width dimension of the body portion 22*a*, and preferably in a region of 40% or more and 85% or less.

Since the tapered portion 23*b* of the fastener element 21 is provided in a range of 10% or more, and preferably 40% or more, it can be more effectively prevent that the sewing thread 7 of the sewn portion for fixing 6*b* overlaps the fastener element 21.

Also, since the tapered portion 23*b* is provided in a region of 90% or lower, and preferably 85% or lower, the body tip end portion 23*a* of the body portion 22*a* can be formed appropriately, and the fixing member 15 can be wrapped by the body portion 22*a* appropriately. Thereby, strength of the fastener element 21 and a adhesion strength of the fastener element 21 to the fixing member 15 can be stably secured. Further, the fixing member 15 can be hidden by the fastener element 21 and can be less seen, thereby appearance quality of the element member 20 and further appearance quality of the slide fastener-attached clothing item 1*a* can be enhanced.

The element member 20 of Embodiment 2 is lined at a position adjacent to an outside in the width direction of the element attaching edge portion 2 of the cloth 5 and fixed with the sewn portion for fixing 6*b*, similar to the case of Embodiment 1. The sewn portion for fixing 6*b* of Embodiment 2 has an upper thread and a lower thread, and is formed to be bent in a zigzag shape with respect to the length direction using a zigzag sewing machine, similar to the case of the above-mentioned Embodiment 1, although a shape of the unit running area 27 formed per fastener element 21 is different from the one in Embodiment 1.

In the case of Embodiment 2, each unit running area 27 of the sewn portion for fixing 6*b* has a first piercing position 28*a* and a second piercing position 28*b* that the sewn portion for fixing 6*b* pierces the element attaching edge portion 2, and the first and second piercing positions 28*a*, 28*b* are disposed to have a constant interval between a position of the side surface part of the fastener element 21 regarding the width direction of the element member 20.

The sewn portion for fixing 6*b* of Embodiment 2 has a first running portion 27*a* disposed linearly to be oblique to the width direction from the outer peripheral crossing position in which the upper thread and the lower thread cross on an outer peripheral surface of the fixing member 15 to a first piercing position 28*a*, a second running portion 27*b* disposed linearly along the length direction from the first piercing position 28*a* to a next second piercing position 28*b*, and a third running portion 27*c* disposed linearly to be oblique to the width direction from the second piercing position 28*b* to a next outer peripheral crossing position.

As mentioned above, the first running portion 27*a* and the third running portion 27*c* of the sewn portion for fixing 6*b* are formed linearly along an oblique direction to the width direction, thereby sewing can be more smoothly performed by a zigzag sewing machine. Further, although the first running portion 27*a* and the third running portion 27*c* of the sewn portion for fixing 6*b* are linearly formed along the oblique direction to the width direction, the tapered portion 23*b* as above is provided on the body portion 22*a* of the fastener element 21 in Embodiment 2, thereby the sewing thread (upper thread 7*a* and lower thread 7*b*) 7 of the sewn portion for fixing 6*b* can be stably prevented from overlapping or getting caught by the fastener element 21. Thus, the sewing thread 7 of the sewn portion for fixing 6*b* is prevented from being loosened, and a state of the element member 20 fixed to the cloth 5 can be stably maintained.

In addition, as the body portion 22*a* has the tapered portion 23*b* as above, a contact region (contact area) of the fastener element 21 contacting with the element attaching edge portion 2 of the cloth 5 can be smaller than in a case of the above-mentioned fastener element of Embodiment 1.

Thereby, the contact of the fastener elements 21 with the element attaching edge portion 2 of the cloth 5 is less affected to flexibility of the element attaching edge portion 2, and the flexibility of the element attaching edge portion 2 can be secured more appropriately.

Since the element attaching edge portion 2 can be formed to be more flexible as above, quality of the slide fastener-attached clothing item 1*a* can be improved. Further, when the slider 40 is slid frontward, right and left fastener elements 21 can be coupled more easily in the element guide path of the slider 40. Thereby, sliding resistance of the slider 40 can be reduced, and slidability and operability of the slider 40 can be improved.

Further, in the right and left element attaching edge portions 2 of the cloth 5 in Embodiment 2, a flange-faced area (slider-faced area) is disposed along the length direction to face to the flange portion 45 of the slider 40, as same as in the case of Embodiment 1. The sewn portion for fixing 6*b* of Embodiment 2 is disposed across the flange-faced area of the element attaching edge portion 2 as a protective part which protects the element attaching edge portion 2 from contacting with the slider 40. Thereby, even when the sliding operation of the slider 40 is repeated, the element attaching edge portion 2 can be less worn out by the flange portion 45 of the slider 40, and durability of the element attaching edge portion 2 can be improved.

Further, the slide fastener-attached clothing item 1*a* of Embodiment 2 having the fastener elements 21 and the sewn portion for fixing 6*b* as above is formed without a fastener tape, thereby an effect as same as that of the slide fastener-attached clothing item 1 of the above-mentioned Embodiment 1 can be obtained.

Embodiment 3

Figure 9:
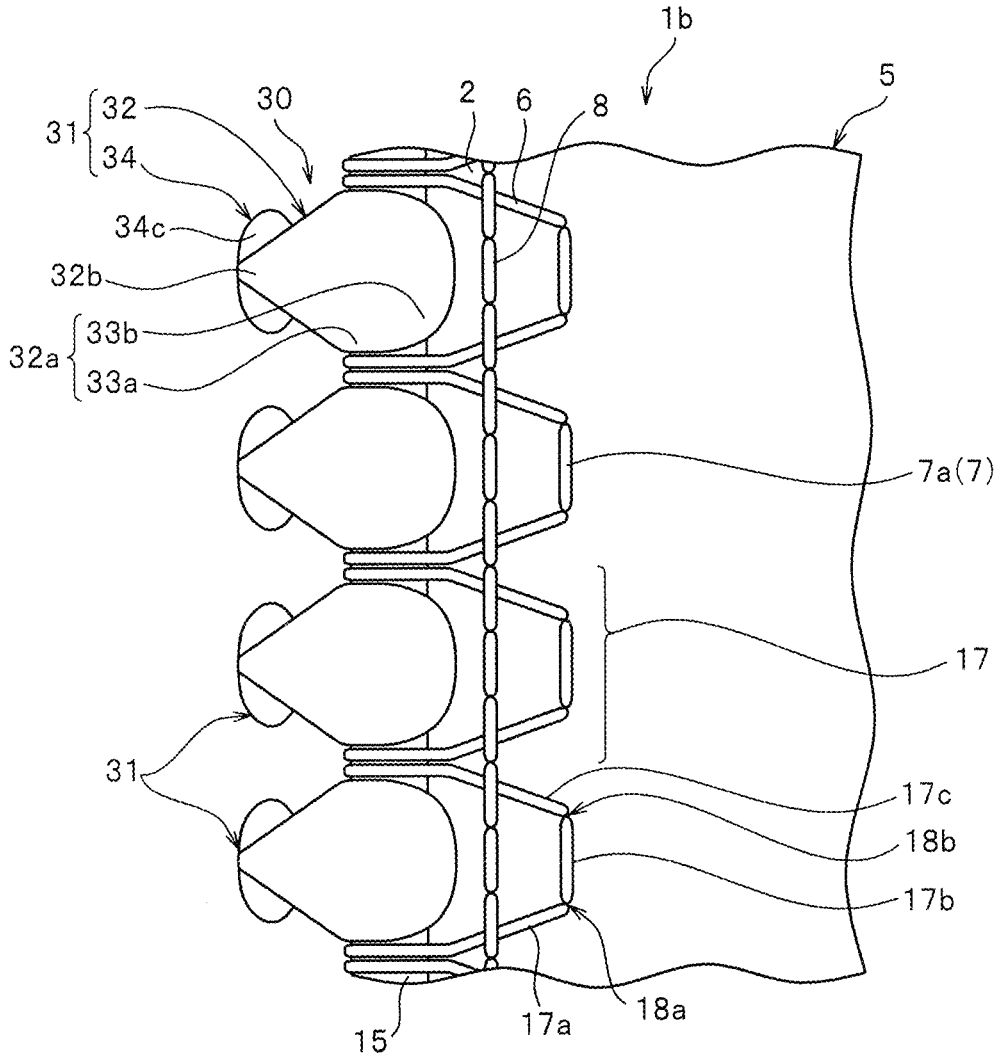
FIG. 9 is a plan view showing a main part of the slide fastener-attached product according to Embodiment 3 of the present invention.
Figure 10:
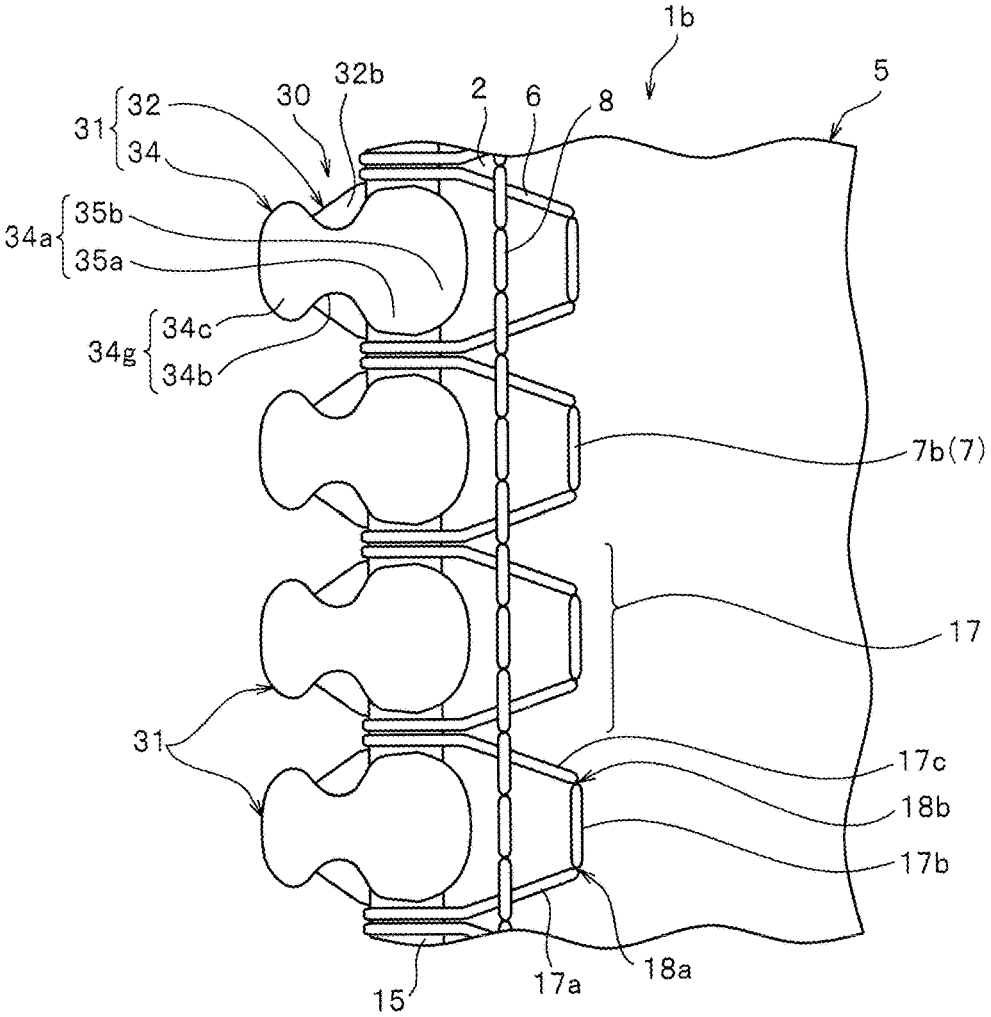
FIG. 10 is a bottom view showing a main part of the slide fastener-attached product according to Embodiment 3.
Figure 11:
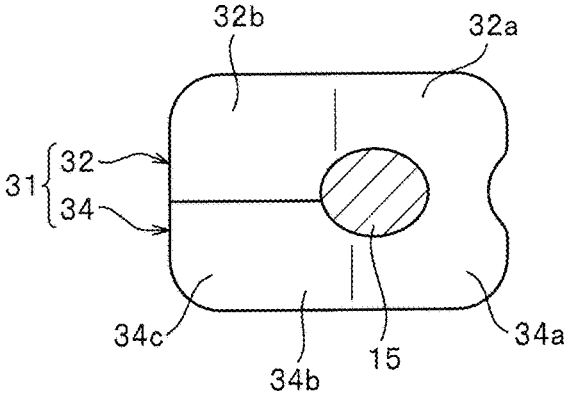
FIG. 11 is a cross-sectional view of the element member in Embodiment 3.

FIG. 9 and FIG. 10 are a plan view and a bottom view showing a main part of the slide fastener-attached clothing item according to Embodiment 3. FIG. 11 is a cross-sectional view of the element member in Embodiment 3.

The slide fastener-attached clothing item 1*b* of Embodiment 3 is formed to have a shape of a fastener element 31 to be different from a shape of the fastener element 11 of the slide fastener-attached clothing item 1 of the above-mentioned Embodiment 1. In the slide fastener-attached clothing item 1 of Embodiment 3, parts other than the fastener element 31 are formed substantially same as those of the slide fastener-attached clothing item 1 of Embodiment 1, as mentioned above.

Each fastener element 31 in the element member 30 of Embodiment 3 has an element upper half portion (first element half portion) 32 and an element lower half portion (second element half portion) 34 distinguished by a height position roughly in the center in the thickness direction. The element upper half portion 32 and the element lower half portion 34 have different shapes from each other. That is, the fastener element 31 of Embodiment 3 has a shape asymmetry in the upper and lower direction unlike the fastener element 11 of Embodiment 1 or the fastener element 21 of Embodiment 2, as mentioned above. In this case, an upper surface of the element upper half portion 32 and a lower surface of the element lower half portion 34 are disposed perpendicular in the thickness direction and parallel to each other.

The element upper half portion 32 of Embodiment 3 has an upper body portion (first body portion) 32*a* holding the fixing member 15 between the element lower half portion 34, and an upper head portion (first head portion) 32*b* extending from the upper body portion 32*a* in the width direction and having a tapered shape.

The upper body portion 32*a* has an upper body tip end portion 33*a* connected to the upper head portion 32*b* and having a constant length dimension, and an upper tapered portion 33*b* extending from the upper body tip end portion 33*a* toward the element attaching edge portion 2 side in the width direction, and the upper tapered portion 33*b* has a shape such that the length dimension is gradually decreased as approaching the element attaching edge portion 2. The upper head portion 32*b* is formed such that the length dimension of the upper head portion 32*b* is gradually decreased toward the tip end part (top end part) to show a substantially triangle shape in a plan view of the fastener element 31.

The lower half portion 34 of Embodiment 3 has a lower body portion (second body portion) 34*a*, a lower neck portion (second neck portion) 34*b* extending from the lower body portion 34*a* in the width direction and having a constrict shape, and a lower coupling head portion (second coupling head portion) 34*c* further extending from the lower neck portion 34*b* in the width direction. In such an element lower half portion 34 of Embodiment 3, a coupling portion 34*g* is formed of the lower neck portion 34*b* and the lower coupling head portion 34*c* to engage with the element lower half portion 34 of the fastener element 31 of the coupling counterpart side.

The lower body portion 34*a* has a lower body tip end portion 35*a* connected to the lower neck portion 34*b* and having a length dimension to gradually increase toward the element attaching edge portion 2 side, and a lower tapered portion 35*b* extending from the lower body tip end portion 35*a* toward the element attaching edge portion 2 side in the width direction and having a length dimension to gradually decrease as approaching the element attaching edge portion 2.

In the fastener element 31 of Embodiment 3, the upper body tip end portion 33*a* having a constant length dimension is formed at the upper head portion 32*b*, and the lower body tip end portion 35*a* gradually increasing the length dimension toward the element attaching edge portion 2 side is formed at the lower body portion 34*a*, thereby fixing strength of the fastener element 31 to the fixing member 15 can be appropriately secured.

Further, in the fastener element 31 of Embodiment 3, the upper tapered portion 33*a* and the lower tapered portion 35*b* gradually decreasing the length dimension toward the element attaching edge portion 2 side, and are formed at the upper head portion 32*b* and the lower body portion 34*a*, respectively, thereby the sewing thread 7 (upper thread 7*a* and lower thread 7*b*) of the sewn portion for fixing 6 for fixing the element member 30 can be prevented from overlapping or getting caught on the fastener element 31.

In a case of the fastener element 31 in Embodiment 3, in particular, a front surface part and a rear surface part disposed on the upper tapered portion 33*b* and the lower tapered portion 35*b* of the fastener element 31 are formed in a curved surface to show a curved shape in a plan view of the fastener element 31, thereby an appearance quality of the fastener element 31 is enhanced.

The slide fastener-attached clothing item 1*b* having the fastener element 31 as above in Embodiment 3 is formed without the fastener tape to be interposed, thereby the same effect as that of the slide fastener-attached clothing item 1 of Embodiment 1 as mentioned above can be obtained. Further, the sewn portion for fixing 6 of Embodiment 3 is formed as the protective part similar to the case of Embodiment 1 as above, thereby the element attaching edge portion 2 can be protected from being contacted with the slider.

Embodiment 4

Figure 12:
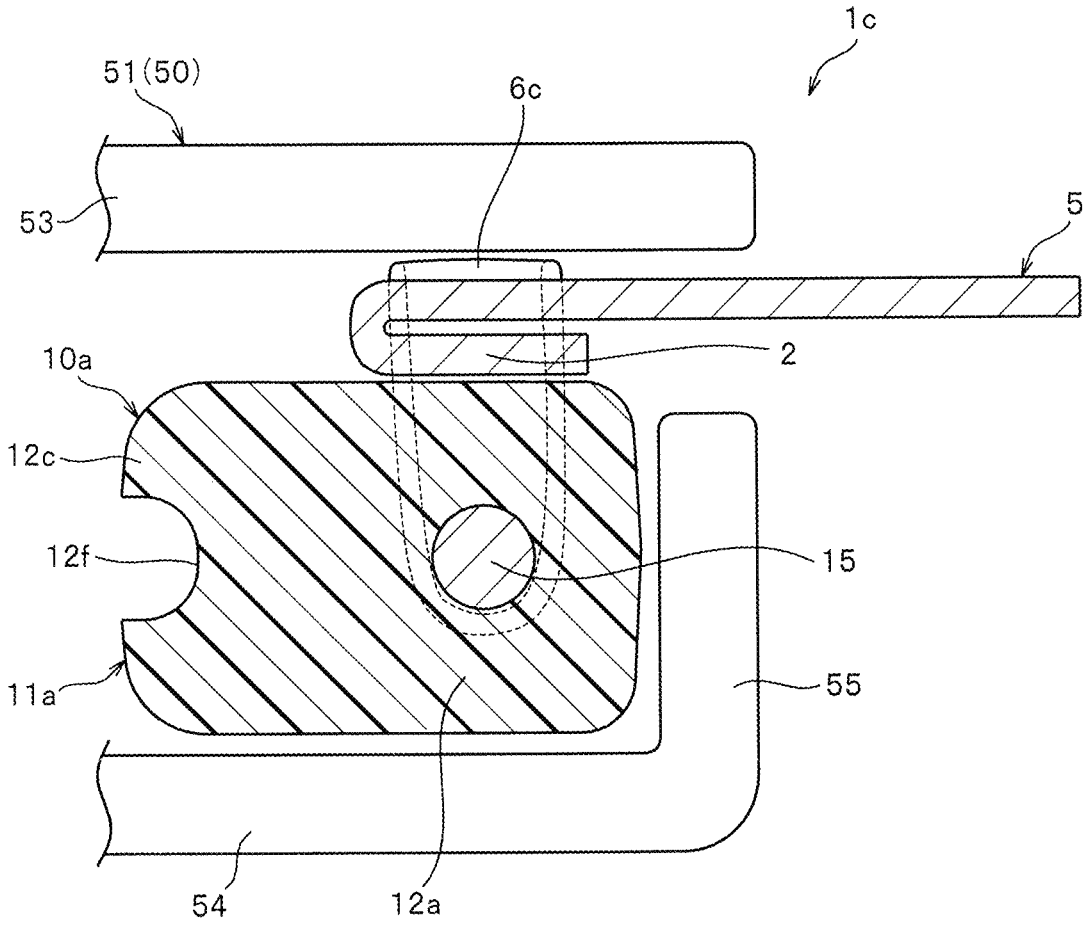
FIG. 12 is a cross-sectional view showing a main part of the slide fastener-attached product according to Embodiment 4 of the present invention.

FIG. 12 is a cross-sectional view showing a main part of the slide fastener-attached clothing item according to Embodiment 4 of the present invention.

In the slide fastener-attached clothing item 1*c* of Embodiment 4, a configuration of fixing the element member 10*a* to the element attaching edge portion 2 of the cloth 5 is different from the configuration of the above-mentioned Embodiments 1 to 3 (configuration of general-type slide fastener). That means, in the slide fastener-attached clothing item 1*c* of Embodiment 4, a so-called back surface slide fastener is formed in which element rows are disposed not to be seen from an outer surface side of the clothing item by fixing the element member 10*a* on the back surface (lower surface) of the element attaching edge portion 2.

Specifically, in the slide fastener-attached clothing item 1*c* of Embodiment 4, the element member 10*a* is directly fixed to the lower surface of the right and left element attaching edge portions 2 with the sewn portion for fixing 6*c*. The slider 50 is formed as a slider for a back surface slide fastener, as described later, and is slidably attached to the element rows formed of a plurality of fastener elements 11*a* of the element member 10*a*.

The element attaching edge portion 2 of cloth 5 in Embodiment 4 is formed such that a side edge part of the cloth 5 is folded to the lower surface side in a U-shape, similar to the element attaching edge portion 2 of the above-mentioned Embodiment 1. Further, on the upper surface of the element attaching edge portion 2 of Embodiment 4, a slider-faced area facing to an inner surface (element guide surface) of an upper blade 53, described later, of the slider 50 is continuously disposed along the length direction.

The element member 10*a* of Embodiment 4 has a plurality of synthetic resin independent fastener elements 11*a* and a single fixing member 15 connecting the plurality of the fastener elements 11*a* at constant intervals. In the element member 10*a*, the insertion concave portion 12*e* disposed in the fastener element 11 of the above-mentioned Embodiment 1 is not provided in each fastener element 11*a*. However, other than that, the element member 10*a* of Embodiment 4 is formed as same as the element member 10 of Embodiment 1.

The element member 10*a* of Embodiment 4 is fixed to the element attaching edge portion 2 of the cloth 5 with the sewn portion for fixing 6*c* formed by lock stitching in a overlapped state on the lower surface side of the element attaching edge portion 2. In this case, the sewn portion for fixing 6*c* to fix the element member 10*a* is formed in a zigzag shape by sewing with a zigzag sewing machine.

The sewn portion for fixing 6*c* fixes the element member 10*a* to the element attaching edge portion 2 of the cloth 5 such that the sewing thread 7 of the sewn portion for fixing 6*c* holds the fixing member 15 of the element member 10*a* to wrap it, and pierces the element attaching edge portion 2 at a position on both of the right and left sides of the fixing member 15. On the piercing position that the sewn portion for fixing 6*c* pierces the element attaching edge portion 2, the upper thread (needle thread) and the lower thread (bobbin thread) of the sewing thread 7 cross each other.

In Embodiment 4, the sewing thread 7 of the sewn portion for fixing 6*c* is disposed on an upper surface of the element attaching edge portion 2 along the length direction to form zigzag stitches. In this case, the sewn portion for fixing 6*c* formed in a zigzag shape is formed to be exposed on the upper surface of the element attaching edge portion 2 and to cover a part of the above-mentioned slider-faced area disposed on the upper surface. By the zigzag-shaped sewn portion for fixing 6*c*, a protective part protecting the upper surface of the element attaching edge portion 2 from a contact with a part of the slider 50 (part of the upper blade 53 described later in the case of Embodiment 4) is formed.

The slider 50 of Embodiment 4 has, a part of which is shown in FIG. 12, a slider body 51 and a tab which is not shown in the drawing. The slider body 51 has the upper blade 53, a lower blade 54 disposed parallel to be apart from the upper blade 53, a connecting column (not shown) connecting front end parts (shoulder mouth side end parts) of the upper blade 53 and the lower blade 54, a flange portion 55 extending from right and left side edge parts of the lower blade 54 toward the upper blade 53, and a tab attaching portion (not shown) disposed on the upper surface of the upper blade 53 and holding the tab.

On a front end part of the slider body 51, right and left shoulder mouths are formed to interpose the connecting column therebetween, and a rear mouth is formed at a rear end part of the slider body 51. Between the upper blade 53 and the lower blade 54, a substantially Y-shaped element guide path is formed to communicate the right and left shoulder mouths and the rear mouth.

The slide fastener-attached clothing item 1*c* of Embodiment 4 as above is formed without using a fastener tape. Therefore, effects such as reduced manufacturing cost, weight saving of clothing item and improved flexibility of the clothing item can be obtained, as same as in the cases of Embodiments 1 to 3. Further, it also becomes possible to easily manufacture a high quality slider fastener-attached clothing item 1*c* provided with waterproof and water repellency.

Furthermore, in Embodiment 4, on the upper surface of the element attaching edge portion 2 of the clothing item, the protective part protecting from a contact with the upper blade 53 of the slider 50 is formed of the zigzag-shaped sewn portion for fixing 6*c*, thereby the element attaching edge portion 2 is less likely to be damaged caused by the sliding of the slider 50.

Embodiment 5

Figure 13:
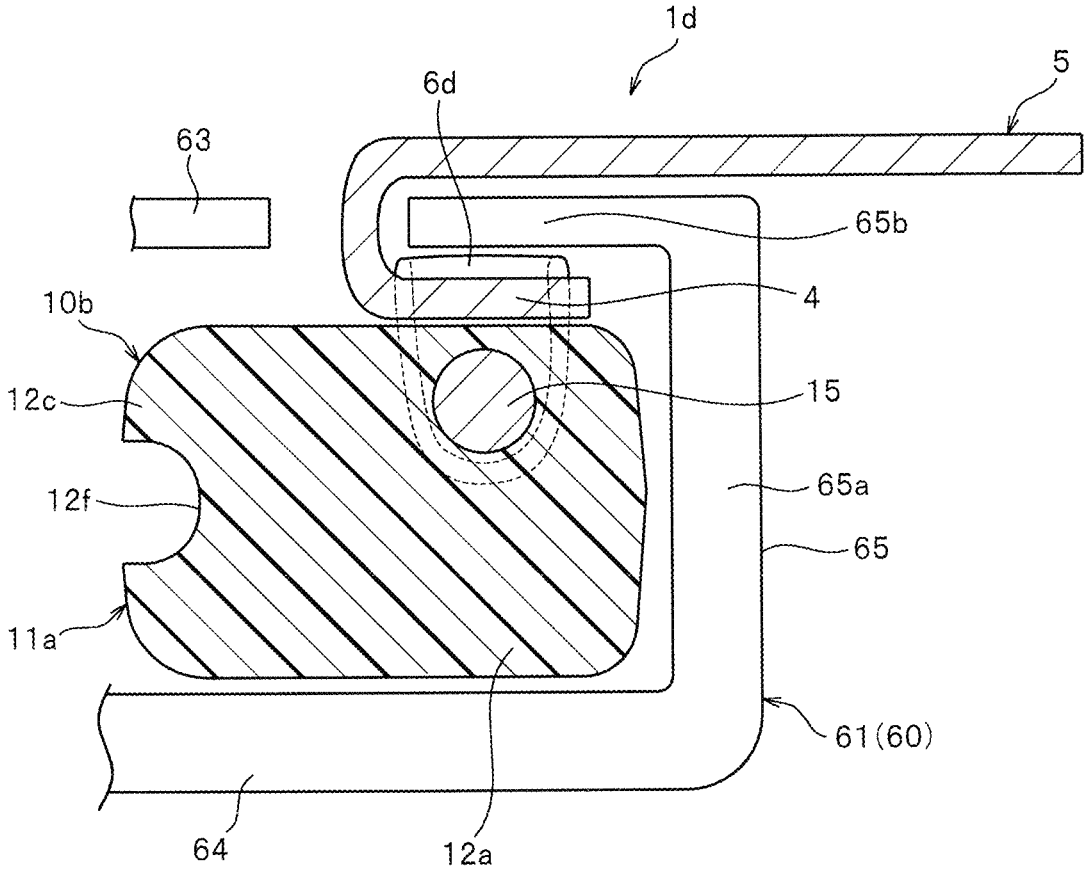
FIG. 13 is a cross-sectional view of the slide fastener-attached product according to Embodiment 5 of the present invention.

FIG. 13 is a cross-sectional view of the slide fastener-attached clothing item according to Embodiment 5 of the present invention.

In the slide fastener-attached clothing item 1*d* of Embodiment 5, a configuration of fixing the element member 10*b* to the element attaching edge portion 4 of the cloth 5 is different from the configurations in the general type slide fastener as in the above-mentioned Embodiments 1 to 3 and the back surface-type slide fastener as in Embodiment 4. In the slide fastener-attached clothing item 1*d* of Embodiment 5, a so-called concealed type slide fastener is formed that a plurality of fastener elements 11*a* and a sewn portion for fixing 6*d* fixing the element member 10*b* are covered by the cloth 5 of the clothing item not to be seen.

Specifically, in the slide fastener-attached clothing item 1*d* of Embodiment 5, a side edge part of the cloth 5 is folded in a U-shape, and the element attaching edge portion 4 attaching the element member 10*b* is formed only by the folded part (folded piece part). The element member 10*b* is directly fixed to the lower surface of the folded element attaching edge portion 4 with the sewn portion for fixing 6*d*.

In Embodiment 5, a coupling head portion 12*c* of each fastener element 11*a* is protruded outside (on the element member 10*b* side on the coupling counterpart side) of a position of a folded portion that the cloth 5 is folded in a U-shape in the width direction. The slider 60 is formed as a slider for the concealed slide fastener provided with right and left flange portions 65 in a reverse L-shape, as described later. The slider 60 is slidably attached to element rows formed of a plurality of fastener elements 11*a* of the element member 10*b*.

The element attaching edge portion 4 formed by folding the cloth 5 of Embodiment 5 has a lower surface to which the element member 10*a* is fixed and an upper surface disposed on an opposite side of the lower surface and formed of an inner peripheral surface of the folded cloth 5.

On the upper surface of the element attaching edge portion 4, a flange-faced area (slider-faced area) facing to an inner surface of a lateral wall portion 65*b*, described later, of the flange portion 65 in the slider 60 is continuously disposed along the length direction.

The element member 10*b* of Embodiment 5 has a plurality of synthetic resin independent fastener elements 11*a* and a single fixing member 15 to which the plurality of fastener elements 11*a* are fixed at constant intervals. In the fastener element 11*a* of Embodiment 5, the insertion concave portion 12*e* as in Embodiment 1 is not provided. However, other than that, it is formed as same shape as the fastener element 11 of Embodiment 1. That is, the fastener element 11*a* of Embodiment 5 is formed as same as the fastener element 11*a* of Embodiment 4 as mentioned above.

The fixing member 15 of Embodiment 5 is not disposed at a center part in the thickness direction of the fastener element 11*a* but a position shifted to an upper side of the thickness direction (a position closer to the element attaching edge portion). In this case, a whole outer periphery of the fixing member 15 is covered by the fastener element 11*a*.

The element member 10*b* of Embodiment 5 is fixed to the element attaching edge portion 4 which is a folded part of the cloth 5 with the sewn portion for fixing 6*d* formed by lock stitching in an overlapped state on the lower surface side of the element attaching edge portion 4. In this case, the sewn portion for fixing 6*d* fixing the element member 10*b* is formed in a zigzag shape by sewing with a zigzag sewing machine.

The sewn portion for fixing 6*d* fixes the element member 10*b* to the element attaching edge portion 4 of the cloth 5 such that the sewing thread 7 of the sewn portion for fixing 6*d* holds the fixing member 15 of the element member 10*b* to wrap it, and pierces the element attaching edge portion 4 at a position of both right and left sides of the fixing member 15. Further, at the piercing position that the sewn portion for fixing 6*d* pierces the element attaching edge portion 4, an upper thread (needle thread) and a lower thread (bobbin thread) of the sewing thread 7 cross each other.

In Embodiment 5, the sewing thread 7 of the sewn portion for fixing 6*d* is disposed on an upper surface of the element attaching edge portion 4 along the length direction to form zigzag stitches. In this case, the sewn portion for fixing 6*d* formed in a zigzag shape on the upper surface of the element attaching edge portion 4 is formed to cover the above-mentioned flange-faced area (slider-faced area) disposed on the upper surface. By the zigzag-shaped sewn portion for fixing 6*d*, a protective part protecting the upper surface of the element attaching edge portion 4 from a contact with a flange portion 65 of the slider 60.

The slider 60 of Embodiment 5 has, a part of which is shown in FIG. 13, a slider body 61 and a tab which is not shown in the drawing. The slider body 61 has a lower blade 64, right and left pair of flange portions 65 standing on both right and left side edge parts of the lower blade 64 and having a reverse L-shape, a center column portion (not shown) standing on a center part in the width direction in a front end part (shoulder mouth side end part) of the lower blade 64, a bulged portion 63 bulging from an upper end part of the center column portion in a direction parallel to the lower blade 64, and a tab attaching portion (not shown) disposed on an upper surface of the center column portion and holding the tab.

The flange portion 65 of the slider body 61 has a vertical wall portion 65*a* standing on the right and left both side edge parts of the lower blade 64, and a lateral wall portion 65*b* extending from an upper end part of the vertical wall portion 65*a* inward in the width direction. Between the bulged portion 63 and the lateral wall portion 65*b* of the flange portion 65 in the slider body 61, an insertion gap to pass the cloth 5 through is formed.

On a front end part of the slider body 61, right and left shoulder mouths are formed to interpose the center column therebetween, and a rear mouth is formed at a rear end part of the slider body 61. A substantially Y-shaped element guide path communicating the right and left shoulder mouths and the rear mouth is formed to be surrounded by the lower blade 64, the right and left flange portions 65 and the bulged portion 63.

The slide fastener-attached clothing item 1*d* of Embodiment 5 as above is formed without using a fastener tape. Therefore, effects such as reduced manufacturing cost, weight saving of clothing item and improved flexibility of the clothing item can be obtained, as same as in the cases of Embodiments 1 to 4. Further, it also becomes possible to easily manufacture a high quality slide fastener-attached clothing item 1*d* provided with waterproof and water repellency.

Furthermore, on the upper surface of the element attaching edge portion 4 in Embodiment 5, the protective part protecting from a contact with the flange portion 65 (lateral wall portion 65*b*) of the slider 60 is formed of the zigzag-shaped sewn portion for fixing 6*d*, thereby the element attaching edge portion 4 is less likely to be damaged due to the sliding of the slider 60.

Embodiment 6

Figure 14:
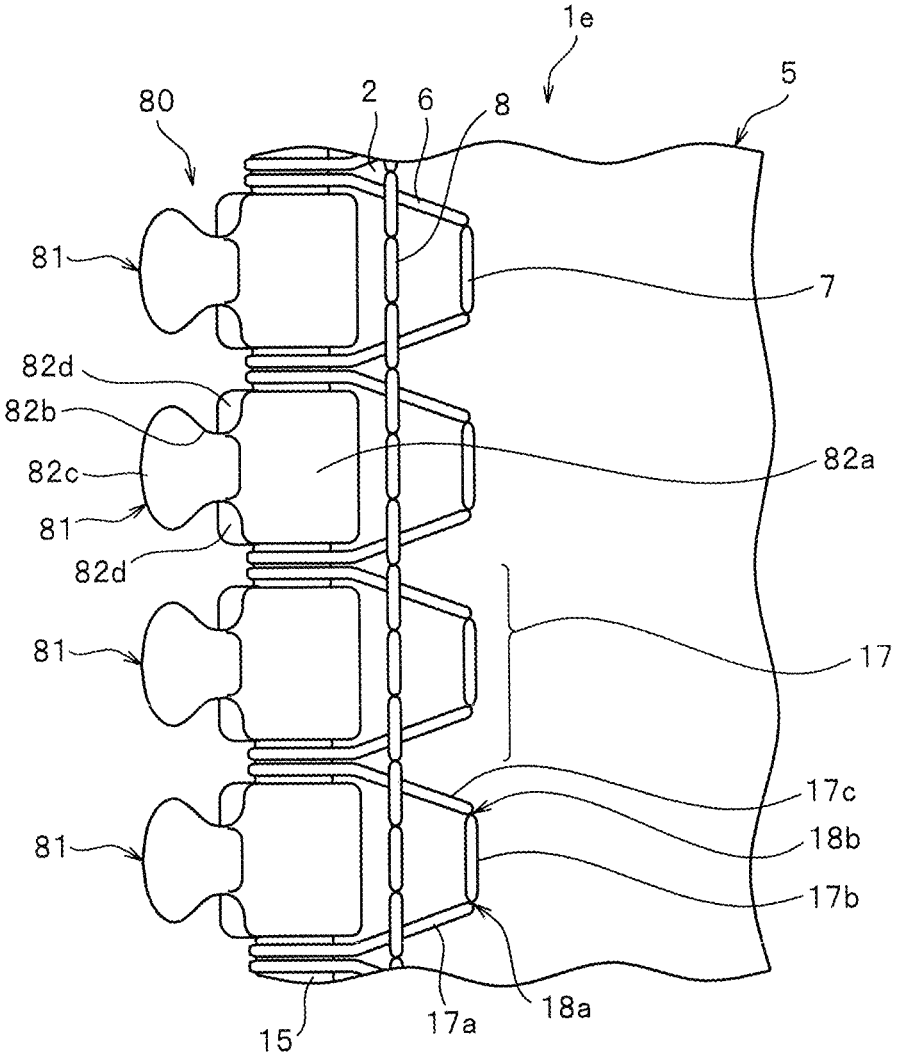
FIG. 14 is a plan view showing a main part of the slide fastener-attached product according to Embodiment 6 of the present invention.
Figure 15:
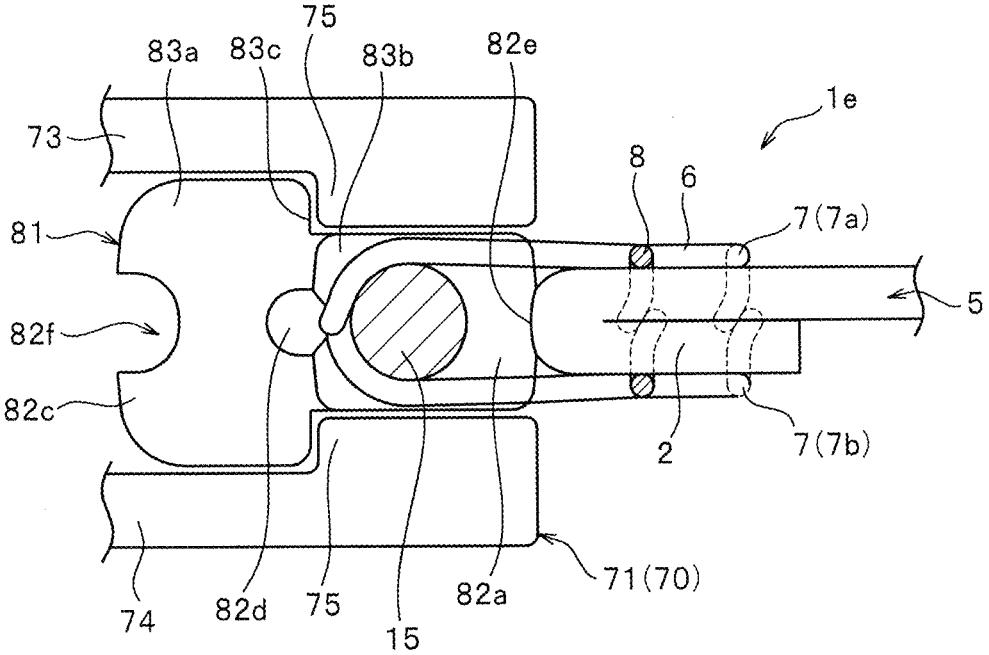
FIG. 15 is a cross-sectional view explaining a relation between the element member and the slider schematically.
Figure 16:
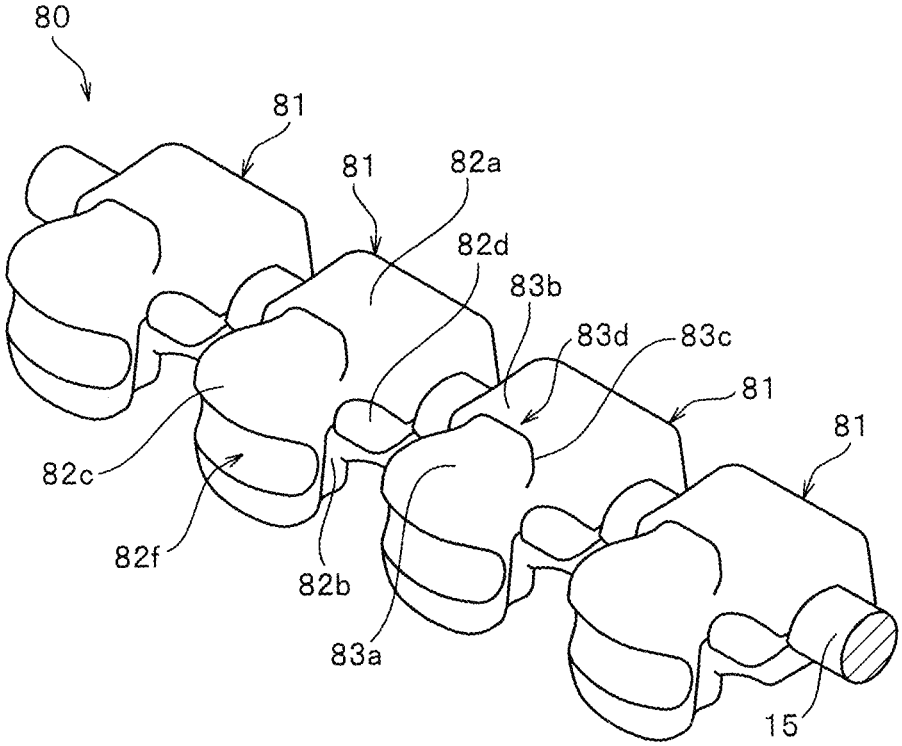
FIG. 16 is a perspective view showing the element member of Embodiment 6.

FIG. 14 is a plan view showing a main part of the slide fastener-attached clothing item according to Embodiment 6 of the present invention. FIG. 15 is a cross-sectional view explaining a relation between the element member and the slider schematically. FIG. 16 is a perspective view showing the element member of Embodiment 6.

A slide fastener-attached clothing item 1*e* of Embodiment 6 is formed differently in a shape of each fastener element 81 disposed on an element member 80, a shape of a slider 70, and a shape of a protective part from those in the slide fastener-attached clothing item 1 in the above-mentioned Embodiment 1. However, other than that, the slide fastener-attached clothing item 1*e* of Embodiment 6 is formed substantially same as the slide fastener-attached clothing item 1 in the above-mentioned Embodiment 1.

The element member 80 of Embodiment 6 is formed by fixing a plurality of synthetic resin fastener elements 81 by injection molding to the fixing member 15 at constant intervals.

The fastener element 81 of Embodiment 6 has a symmetrical shape in the upper and lower direction based on a center position in the thickness direction. The fastener element 81 has a body portion 82*a* fixed to the fixing member 15 so as to wrap the fixing member 15, a neck portion 82*b* extending from the body portion 82*a*, a coupling head portion 82*c* further extending from the neck portion 82*b*, and a protruded piece portion 82*d* protruded from the neck portion 82*b* frontward and rearward in a thin plate shape.

In the center part in the thickness direction of the body portion 82*a*, the fixing member 15 is penetrated along the length direction. At a side surface part of the body portion 82*a* facing to the cloth 5, an insertion concave portion 82*e* to which a part of the element attaching edge portion 2 is inserted is formed along the length direction. At a tip end part of the coupling head portion 82*c*, a concave groove portion 82*f* is formed along the length direction.

The fastener element 81 of Embodiment 6 has a first element portion 83*a* and a second element portion 83*b* having different thickness dimensions (dimensions in the thickness direction) from each other. In this case, an upper surface part and a lower surface part of the first element portion 83*a* and an upper surface part and a lower surface part of the second element portion 83*b* are respectively formed of flat surfaces perpendicular to the thickness direction.

The first element portion 83*a* of the fastener element 81 is formed to include at least a part of the neck portion 82*b* and the coupling head portion 82*c* and to have a larger thickness dimension than the second element portion 83*b*. The thickness dimension of the first element portion 83*a* is set corresponding to an interval between an inner surface of an upper blade 73 and an inner surface of a lower blade 74 of a slider 70, described later, in the upper and lower direction.

The second element portion 83*b* of the fastener element 81 is formed to extend from the first element portion 83*a* via a step 83*c* in a direction approaching the cloth 5 in the width direction (in other words, a direction away from the coupling head portion 82*c*) and to include at least a part of the body portion 82*a*. A thickness dimension of the second element portion 83*b* is set to be smaller than the thickness dimension of the first element portion 83*a* via the step 83*c*, and set to correspond to a size of an insertion gap formed between an upper side flange portion 75 and a lower side flange portion 75, described later, of the slider 70.

In this case, the step 83*c* disposed at a boundary of the first element portion 83*a* and the second element portion 83*b* is formed by a difference between the thickness dimension of the first element portion 83*a* and the thickness dimension of the second element portion 83*b*, and to be symmetrical on both the upper surface side and the lower surface side of the fastener element 81.

In each fastener element 81 of Embodiment 6, upper and lower concave portions for flange 83*d* which can accept and pass through the upper side flange portion 75 and the lower side flange portion 75 of the slider 70 respectively are formed by a step surface of the step 83*c* and an upper surface of the second element portion 83*b*, and by the step surface of the step 83*c* and a lower surface of the second element portion 83*b* to correspond to positions of the upper side flange portion 75 and the lower side flange portion 75, respectively. In this case, the upper side concave portion for flange 83*d* is formed on an upper side of an upper end of the fixing member 15 regarding the upper and lower direction, as shown in FIG. 15, and further on an upper side of a position of the sewn portion for fixing 6 holding the fixing member 15. The lower concave portion for flange 83*d* is formed on a lower side of a lower end of the fixing member 15 regarding the upper and lower direction, and further on a lower side of a position of the sewn portion for fixing 6 holding the fixing member 15.

The slider 70 of Embodiment 6 has, a part of which is shown in FIG. 15, a slider body 71 and a tab (not shown) held by the slider body 71. The slider body 71 of Embodiment 1 has the upper blade 73, the lower blade 74 disposed parallel to be apart from the upper blade 73, a connecting column (not shown) connecting the upper blade 73 and a front end part (shoulder mouth side end part) of the lower blade 74, upper and lower flange portions 75 disposed on right and left side edge parts of the upper blade 73 and the lower blade 74, and a tab attaching portion (not shown) disposed on the upper surface of the upper blade 73 and holding the tab.

On a front end part of the slider body 71 of Embodiment 6, right and left shoulder mouths are formed to interpose the connecting column therebetween, and a rear mouth is formed at a rear end part of the slider body 71. Between the upper blade 73 and the lower blade 74, a substantially Y-shaped element guide path is formed to communicate the right and left shoulder mouths and the rear mouth. Further, between the upper and lower flange portions 75 in the slider body 71, an insertion gap to pass the second element portion 83*b* of the fastener element 81 through is formed.

Particularly, the slider body 71 of Embodiment 6 is formed to have a smaller interval between the right and left flange portions 75, and to have a larger interval between the upper side flange portion 75 and the lower side flange portion 75 compared with that in the slider body 41 of the above-mentioned Embodiment 1.

The upper and lower flange portions 75 in the slider 70 of Embodiment 6 has a shape and a size corresponding to the above-mentioned concave portions for flange 83*d* provided at each fastener element 81 in a relationship between the fastener element 81. In other words, when viewing a cross-section perpendicular to the length direction of the fastener element 81 and the flange portions 75 of the slider 70, the flange portion 75 of the slider 70 has a cross-sectional shape as same as, or corresponding to, that of the concave portion for flange 83*d* of the fastener element 81. The flange portion 75 of the slider 70 also has a size to be able to be accommodated in the concave portion for flange 83*d* of the fastener element 81 and to engage with the step 83*c* between the first element portion 83*a* and the second element portion 83*b*.

In such a slide fastener-attached clothing item 1*e* of Embodiment 6 as above, each concave portion for flange 83*d* disposed on an upper surface side and a lower surface side of each fastener element 81 is formed to have a constant cross-sectional shape perpendicular to the length direction. The concave portion for flange 83*d* formed on a plurality of the fastener elements 81 is provided with the element attaching edge portion 2 of the clothing item as the protective part to protect from the upper and lower flange portions 75 of the slider 70.

Specifically, in the element member 80 to which a plurality of the fastener elements 81 are fixed at equal intervals, a path to be able to pass the upper and lower flange portions 75 of the slider 70 through is formed by the concave portion for flange 83*d* formed at each fastener element 81 along the length direction of the element member 80. Thereby, when the slider 70 slides, the upper and lower flange portions 75 move in the concave portion for flange 83*d* of the fastener element 81 disposed away from the element attaching edge portion 2 of the clothing item, and the upper and lower flange portions 75 can be prevented from directly slide-contacting with the element attaching edge portion 2 of the clothing item.

Accordingly, in the slide fastener-attached clothing item 1*e* of Embodiment 6, even when the sliding operation of the slider 70 is repeated, the element attaching edge portion 2 of the clothing item is not worn out due to sliding of the slider 70, and the sewn portion for fixing 6 or the auxiliary sewn portion 8 is not worn out due to the sliding of the slider 70. Therefore, durability of the clothing item (durability in the element attaching edge portion 2 of the cloth 5, in particular) can be significantly improved.

The slide fastener-attached clothing item 1*e* of Embodiment 6 as above is formed without using a fastener tape as in the cases of Embodiments 1 to 5. Therefore, effects such as reduced manufacturing cost, weight saving of clothing item and improved flexibility of the clothing item can be obtained. Further, it also becomes possible to easily manufacture a high quality slide fastener-attached clothing item 1*e* provided with waterproof and water repellency.

In the slide fastener-attached clothing item 1, 1*a*, 1*b*, 1*e* of the above-mentioned Embodiments 1 to 3 and Embodiment 6, the element member 10, 20, 30, 80 is firmly fixed at a position adjacent to an outside in the width direction with respect to the element attaching edge portion 2 of the cloth 5 with the sewn portion for fixing 6, 6*b* formed by a zigzag sewing machine and the auxiliary sewn portion 8 formed by a lock stitch sewing machine.

Figure 17:
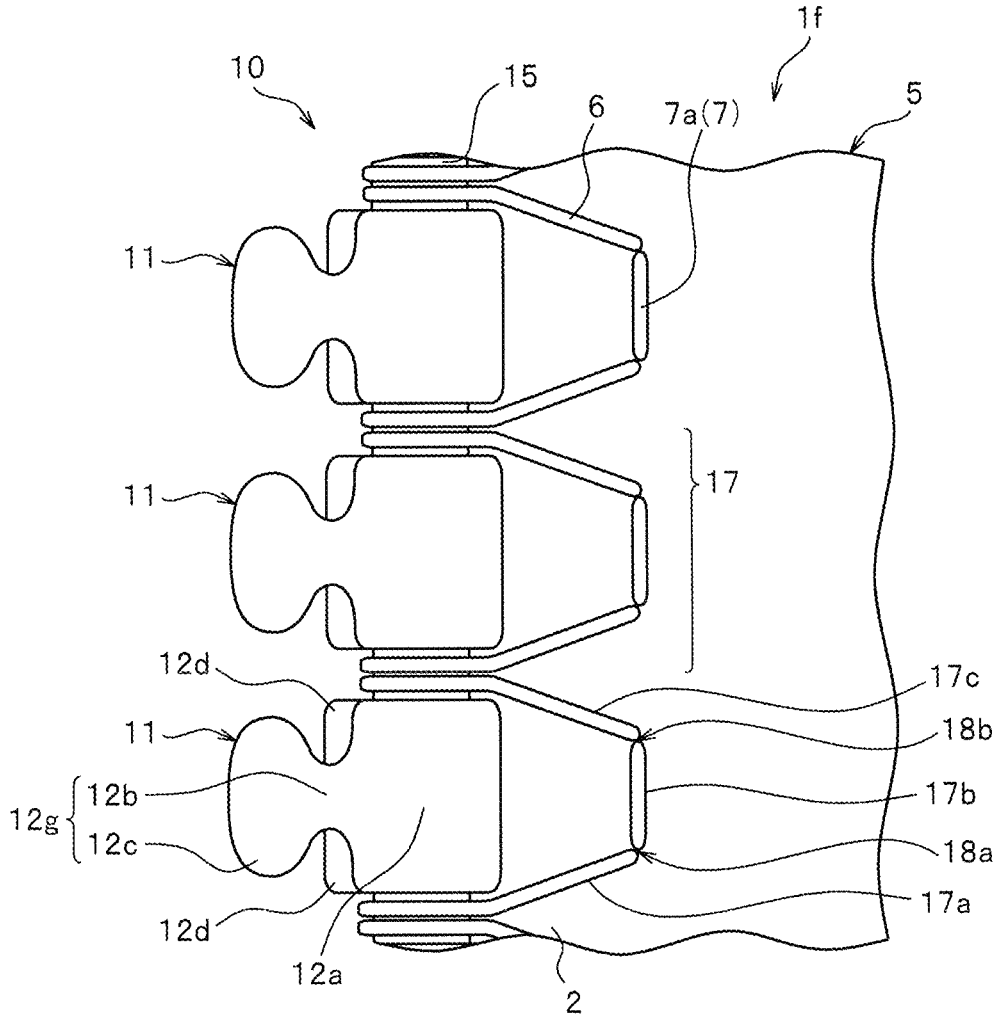
FIG. 17 is a plan view showing a main part of the slide fastener-attached product according to another modification example of Embodiment 1.

However, it is also possible in the present invention that, as the slide fastener-attached clothing item if according to another modification example of Embodiment 1 is shown in FIG. 17, the element member 10 is fixed to the element attaching edge portion 2 of the cloth 5 only with the sewn portion for fixing 6 in a zigzag shape without forming the above-mentioned auxiliary sewn portion for fixing 8 formed by a lock stitch sewing machine, as mentioned above.

Further in this case, it is also possible to use a welding thread (fusion thread) having a core-sheath structure to at least one of the upper thread (needle thread) and the lower thread (bobbin thread) forming the zigzag-shaped sewn portion for fixing 6, instead of an ordinary sewing machine thread as in the above-mentioned Embodiment 1. For the welding thread having the core-sheath structure, a core portion of the welding thread is formed of a fiber material which is not melted even over a predetermined temperature, or a fiber material having thermal contraction property to contract by heating. The sheath portion of the welding thread is formed of a fiber material having a thermal fusion property fusing by being heated over a predetermined temperature.

In a case that the welding thread having such a core-sheath structure is used to at least one of the upper thread and the lower thread of the sewn portion for fixing 6, even when the auxiliary sewn portion 8 as in the case of Embodiment 1 is not formed, the element member 10 can be firmly fixed with the sewn portion for fixing 6 by conducting a heat treatment to the sewn portion for fixing 6 after being formed. Further, the upper thread and the lower thread of the sewn portion for fixing 6 can be prevented from being loosened.

Figure 18:
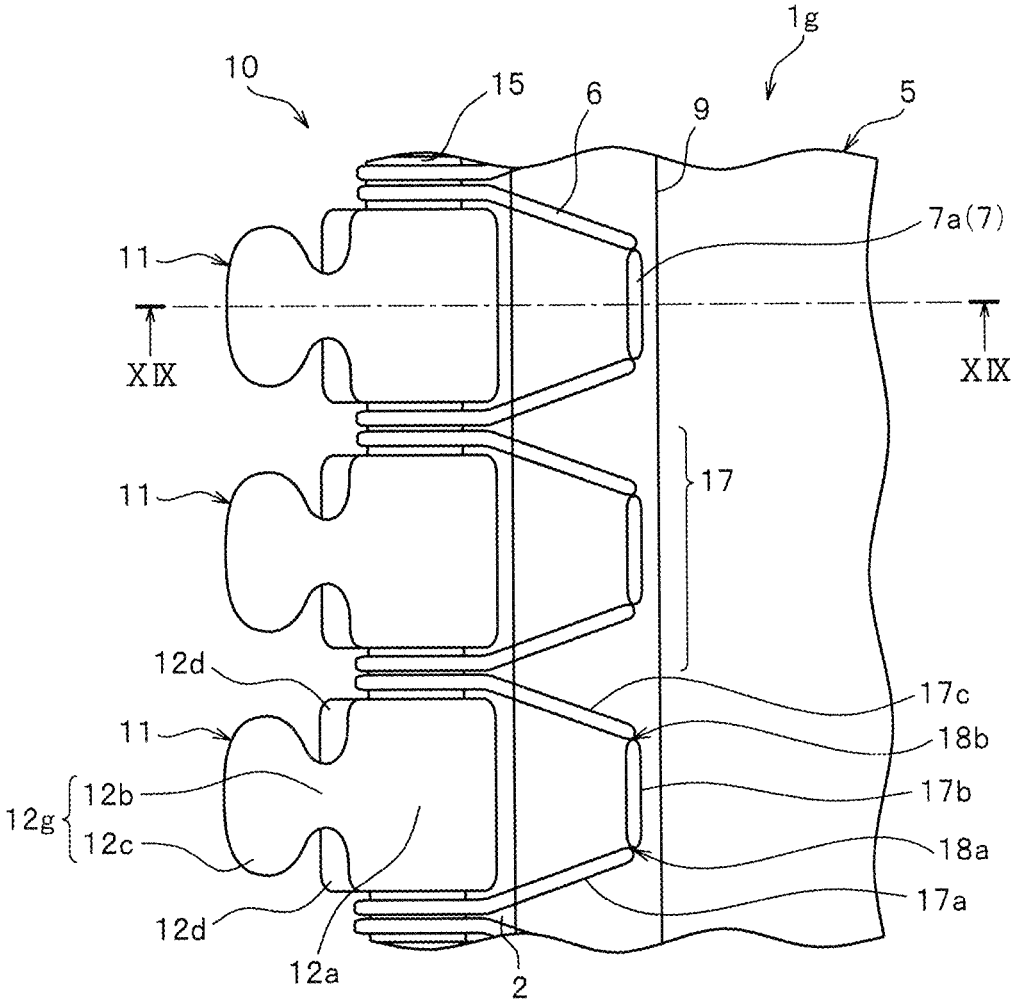
FIG. 18 is a plan view showing a main part of the slide fastener-attached product according to yet another modification example of Embodiment 1.
Figure 19:
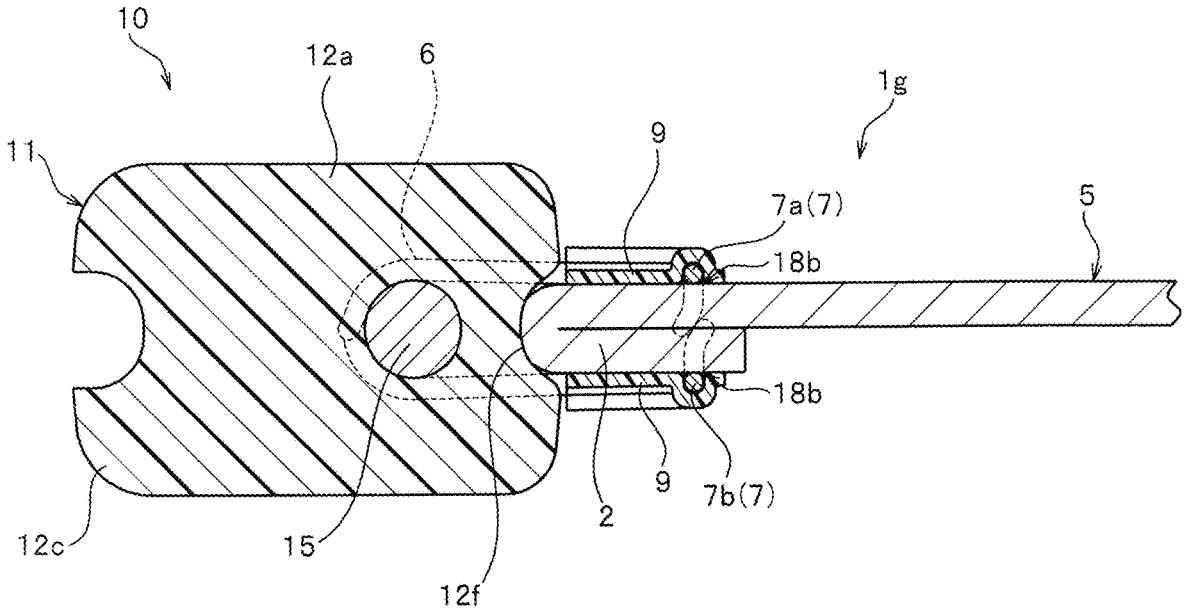
FIG. 19 is a cross-sectional view along the line XIX-XIX in FIG. 18.

Further in the present invention, it is also possible that, as shown in a slide fastener-attached clothing item 1*g* according to yet another modification example of Embodiment 1 in FIGS. 18 and 19, for example, a transparent film member (tape member) 9 is applied on the sewn portion for fixing 6 formed in a zigzag shape for fixing the sewn portion for fixing 6 to the element attaching edge portion 2 of the cloth 5, instead of forming the auxiliary sewn portion 8 formed by a lock stitch sewing machine. The film member 9 is also referred to as a film member for fixing thread for fixing the sewing thread 7 of the sewn portion for fixing 6. In this case, the film member 9 is applied on at least one surface of the top surface and the back surface of the element attaching edge portion 2 so as to cover at least a part of the sewn portion for fixing 6 including the first piercing position 18*a* and the second piercing position 18*b* of the sewn portion for fixing 6.

Thereby, at least one of the upper thread 7*a* and the lower thread 7*b* of the sewn portion for fixing 6 can be firmly fixed to the element attaching edge portion 2. Accordingly, even when the above-mentioned auxiliary sewn portion 8 is not formed on the sewn portion for fixing 6, the element member 10 can be firmly fixed with the sewn portion for fixing 6.

Further, in the slide fastener-attached clothing item 1*g* as shown in FIGS. 18 and 19, the protective part protecting from a contact with the flange portion 45 of the slider 40 is formed on the upper surface of the element attaching edge portion 2 with the zigzag-shaped sewn portion for fixing 6. In addition, the film member 9 is applied on the upper surface and the lower surface of the element attaching edge portion 2 to cover the sewn portion for fixing 6 which serves as the protective part. Thereby, the film member 9 can more stably protect the element attaching edge portion 2 of the clothing item together with the sewn portion for fixing 6 serving as the protective part from a contact with the flange portion 45 of the slider 40.

In the present invention, it is also possible that the upper thread 7*a* and the lower thread 7*b* of the sewn portion for fixing 6 are bonded and firmly fixed to the element attaching edge portion 2 by applying an adhesive to a region in which the above-mentioned film member 9 is to be applied or coating the region with the adhesive instead of applying the film member 9.

In the present invention, it is also possible that the piercing position that the sewn portion for fixing pierces the element attaching edge portion of the cloth is apart further from the cloth-faced side surface part of the fastener element inward the cloth than in the case of Embodiment 1. In this case, the sewn portion for fixing can be formed in a zigzag shape such that, in each unit running area of the sewn portion for fixing, the number of the piercing positions that the sewn portion for fixing pierces the element attaching edge portion is reduced to one from two as shown in FIG. 2. Alternately, it is also possible in each unit running area to increase the number of the piercing positions that the sewn portion for fixing pierces the element attaching edge portion to three or more, for example.

Further, in the above-mentioned Embodiments 1 to 4 and 6, the side edge part of the cloth 5 is folded in a U-shape to form the element attaching edge portion 2, thereby strength of the element attaching edge portion 2 is enhanced. In addition, in a case a cut end edge (side end edge) of the cloth 5 is frayed, the fray can be hidden on the back surface side of the element attaching edge portion 2 not to be seen.

In the present invention, however, the element attaching edge portion 2 may be formed in a state that the side edge part of the cloth 5 is extended straight in the width direction without being folded in a U-shape. When the side edge part of the cloth 5 is extended straight in the width direction to form the element attaching edge portion, the strength of the straight-formed element attaching edge portion can be stably enhanced by impregnating the side edge part of the cloth 5 with a reinforcement agent or applying a synthetic resin reinforcing film member to the side edge part of the cloth 5 so as to wrap the side edge part inside.

In this case, the reinforcement agent to impregnate the cloth 5 is a curable adhesive, and the reinforcement agent such as single curable adhesive, two-pack curable adhesive, instant adhesive, hot melt adhesive, emulsion adhesive, or light curing adhesive which is cured by ultraviolet ray or electron beam can be used. The reinforcement film member to be applied on the cloth 5 is a film-type member which can enhance the strength of the cloth 5 by application. It is preferable to use a film member having low elasticity or no elasticity as the reinforcement film member.

In a case that the element attaching edge portion is reinforced by impregnation of the reinforcement agent or the application of the reinforcement film member, durability of the element attaching edge portion can be enhanced because when the upper thread and the lower thread of the sewn portion for fixing pierce the element attaching edge portion, for example, the element attaching edge portion can be less likely to be cut by the upper thread and the lower thread.

Further, since the element member is firmly fixed to the straight element attaching edge portion, the position and the columnure of each element 11 fixed to the element attaching edge portion can be stabilized. In addition, the thread can be less likely to be frayed at the side end edge of the element attaching edge portion by impregnating the reinforcement agent or applying the reinforcement film member to the element attaching edge portion.

REFERENCE SIGNS LIST

1, 1*a*, 1*b* Slide fastener-attached clothing item (product)
1*c*, 1*d*, 1*e* Slide fastener-attached clothing item (product)
1*f*, 1*g* Slide fastener-attached clothing item (product)
2 Element attaching edge portion
2*a* Flange-faced area (slider-faced area)
3 Element row
4 Element attaching edge portion
5 Cloth (Fastener attached member)
6, 6*a*, 6*b* Sewn portion for fixing
6*c*, 6*d* Sewn portion for fixing
7 Sewing thread
7*a* Upper thread (needle thread)
7*b* Lower thread (bobbin thread)
8 Auxiliary sewn portion
9 Film member (tape member)
10, 10*a* Element member
10*b* Element member
11,11*a* Fastener element
12*a* Body portion
12*b* Neck portion
12*c* Coupling head portion
12*d* Protruded piece portion
12*e* Insertion concave portion
12*f* Concave groove portion
12*g* Coupling portion
15 Fixing member
17 Unit running area
17*a* First running portion
17*b* Second running portion
17*c* Third running portion
18*a* First piercing position
18*b* Second piercing position
19 Unit running area
19*a* First running portion
19*b* Second running portion
19*c* Third running portion
20 Element member
21 Fastener element
22*a* Body portion
22*b* Neck portion
22*c* Coupling head portion
22*d* Protruded piece portion
22*f* Concave groove portion
22*g* Coupling portion
23*a* Body tip end portion
23*b* Tapered portion
27 Unit running area
27*a* First running portion
27*b* Second running portion
27*c* Third running portion
28*a* First piercing position
28*b* Second piercing position
30 Element member
31 Fastener element
32 Element upper half portion (first element half portion)
32*a* Upper body portion (first body portion)
32*b* Upper head portion (first head portion)
33*a* Upper body tip end portion
33*b* Upper tapered portion
34 Element lower half portion (second element half portion)
34*a* Lower body portion (second body portion)
34*b* Lower neck portion (second neck portion)
34*c* Lower coupling head portion (second coupling head portion)
34*g* Coupling portion
35*a* Lower body tip end portion
35*b* Lower tapered portion
40 Slider
41 Slider body
42 Tab
43 Upper blade
44 Lower blade
45 Flange portion
46 Tab attaching portion
50 Slider
51 Slider body
52 Upper blade
54 Lower blade
55 Flange portion
60 Slider
61 Slider body
63 Bulged portion
64 Lower blade
65 Flange portion
65*a* Vertical wall portion
65*b* Lateral wall portion
70 Slider
71 Slider body
73 Upper blade
74 Lower blade
75 Flange portion
80 Element member
81 Fastener element
82*a* Body portion
82*b* Neck portion
82*c* Coupling head portion
82*d* Protruded piece portion
82*e* Insertion concave portion
82*f* Concave groove portion
83*a* First element portion
83*b* Second element portion
83*c* Step
83*d* Concave portion for flange W dimension (distance) in the width direction between the first and second piercing positions of the sewn portion for fixing and the fastener element

The invention claimed is:

1. A slide fastener-attached product comprising:

a pair of element members in which fastener elements are attached to a fixing member, a fastener attached member having a pair of element attaching edge portions to which the element members are attached in a position facing to each other, and at least one slider attached to element rows formed of the fastener elements in a slidable manner, each of the element members is directly fixed to one of the element attaching edge portions with a sewn portion for fixing, each of the element members is fixed along one of the element attaching edge portions at a position outside of the element attaching edge portion in a width direction of the element member, each of the sewn portions for fixing pierces the element attaching edge portion and sewing threads forming the sewn portion for fixing hold the fixing member, and protective parts protecting at least a part of each of the element attaching edge portions from a contact with the slider.

2. The slide fastener-attached product according to claim 1, wherein:

a slider-faced area facing to a part of the slider to be slid is disposed at the element attaching edge portion of the fastener attached member along a length direction of the element member, the sewing thread of the sewn portion for fixing is disposed on at least a part of the slider-faced area of the element attaching edge portion, and the protective part is formed of the sewing thread in the slider-faced area.

3. The slide fastener-attached product according to claim 2, wherein:

the sewing thread of the sewn portion for fixing is disposed in a zigzag shape as the protective part in the slider-faced area of the element attaching edge portion.

4. The slide fastener-attached product according to claim 2, wherein:

the slider has an upper blade and a lower blade disposed parallel to each other, a connecting column connecting the upper blade and the lower blade, and a flange portion disposed at each of right and left side edge parts of at least one of the upper blade and the lower blade, and the slider-faced area is disposed at the element attaching edge portion of the fastener attached member along the length direction of the element member so as to face to the flange portion of the sliding slider.

5. The slide fastener-attached product according to claim 1, wherein:

the slider has an upper blade and a lower blade disposed parallel to each other, a connecting column connecting the upper blade and the lower blade and a flange portion disposed on each of right and left side edge parts of at least one of the upper blade and the lower blade, the fastener element has a concave portion for flange disposed on at least one of an upper half portion and a lower half portion of the fastener element and along the length direction of the element member, and disposed corresponding to a position of the flange portion of the slider, and the protective part is formed of the concave portions for flange of a plurality of the fastener elements.

6. The slide fastener-attached product according to claim 5, wherein:

the fastener element has a first element portion including a coupling head portion to be engaged with the fastener element of a coupling counterpart side and having a dimension in an element thickness direction to correspond to an interval between the upper blade and the lower blade in the slider, and a second element portion extending in a direction apart from the first element portion with respect to the coupling head portion in the width direction and having a smaller dimension in the element thickness direction than the first element portion via a step, and the concave portion for flange is formed in the fastener element by a difference in the element thickness dimension between the first element portion and the second element portion.

7. The slide fastener-attached product according to claim 1, wherein:

the sewn portion for fixing is formed by lock stitching.

8. The slide fastener-attached product according to claim 1, wherein:

the sewn portion for fixing is formed to be bent in a zigzag shape with respect to a length direction of the element member.

9. The slide fastener-attached product according to claim 1, wherein:

a plurality of the fastener elements are respectively formed independently and disposed on the fixing member at equal intervals, and the sewn portion for fixing is formed such that the sewing thread repeats a predetermined pattern of stitches per fastener element.

10. The slide fastener-attached product according to claim 1, wherein:

the element attaching edge portion of the fastener attached member is formed such that a side edge part of the fastener attached member is folded in a width direction of the element member.

11. The slide fastener-attached product according to claim 1, wherein:

the fastener element has a body portion fixed to the fixing member and a coupling portion engaging with the fastener element of the element member on the coupling counterpart side, and the body portion has a tapered portion in which a dimension of the body portion of the element member in the length direction is gradually decreased with distance from the coupling portion in a plan view of the fastener element.

* * * * *